US006230363B1

(12) United States Patent
Kawai et al.

(10) Patent No.: US 6,230,363 B1
(45) Date of Patent: May 15, 2001

(54) LARGE-SCALE CLEANING VEHICLE

(75) Inventors: Yuzo Kawai; Katsutoshi Nakamura, both of Nara-ken (JP)

(73) Assignee: Suiden Co., Ltd. (JP)

( * ) Notice: Subject to any disclaimer, the term of this patent is extended or adjusted under 35 U.S.C. 154(b) by 0 days.

(21) Appl. No.: 09/395,949

(22) Filed: Sep. 14, 1999

Related U.S. Application Data

(62) Division of application No. 08/856,458, filed on May 14, 1997, now Pat. No. 5,987,699.

(30) Foreign Application Priority Data

| | | |
|---|---|---|
| May 31, 1996 | (JP) | 8-138041 |
| May 14, 1996 | (JP) | 8-118728 |
| Aug. 6, 1996 | (JP) | 8-206930 |
| Aug. 23, 1996 | (JP) | 8-222084 |
| Dec. 27, 1996 | (JP) | 8-349375 |
| Mar. 21, 1997 | (JP) | 9-67910 |

(51) Int. Cl.[7] ..... A47L 5/08

(52) U.S. Cl. ..... 15/339; 15/27; 15/83; 15/349

(58) Field of Search ..... 15/83, 339, 349, 15/82, 27, 319

(56) References Cited

U.S. PATENT DOCUMENTS

| | | | | |
|---|---|---|---|---|
| 880,124 | * | 2/1908 | Butler | 15/349 X |
| 1,087,588 | * | 2/1914 | Killman | 15/349 X |
| 1,207,816 | * | 12/1916 | Thompson | 15/349 X |
| 2,709,269 | * | 5/1955 | Williams | 15/83 X |
| 3,006,021 | * | 10/1961 | Patch | 15/349 X |
| 3,354,489 | * | 11/1967 | Ehrlich | 15/83 |
| 3,568,489 | * | 3/1971 | Swanson | 15/83 |

* cited by examiner

*Primary Examiner*—Chris K. Moore
(74) *Attorney, Agent, or Firm*—Morrison Law Firm

(57) ABSTRACT

A large-scale cleaning vehicle, for operation with a forklift, includes rotation brushes for sweeping debris toward a center of said cleaning vehicle, a sweeping brush for sweeping the debris into a debris collection box and a fan for pulling said debris into said debris collection box without the need for a motor in the cleaning vehicle. Each of the rotation brushes, the sweeping brush, and the fan are rotatably connected to a rear wheel of the cleaning vehicle such that when the cleaning vehicle is moved, the brushes and fan are rotated. The cleaning vehicle further includes a vertical adjustment for the rotation brushes to lift them when they are not needed, a lateral adjustment for the rotation brushes to adjust a width of sweeping, an audible warning for pedestrians, a water sprinkler system to aid in the cleaning process, and a large-scale trash removal brush mounted in front of the cleaning vehicle to push large-scale trash.

4 Claims, 21 Drawing Sheets

LARGE-SCALE CLEANING VEHICLE

This application is a division of application Ser. No. 08/856,458, filed May 14, 1997, now U.S. Pat. No. 5,987, 699, issued Nov. 23, 1999.

BACKGROUND OF THE INVENTION

The present invention relates to large-scale cleaning vehicles. More specifically, the present invention relates to a large-scale cleaning vehicle that is pushed forward using a forklift vehicle. The present invention also relates to structural elements and accessories for the same.

Referring to FIG. 6, a frame 1 serves as a main body of a conventional cleaning vehicle, on which is mounted an engine 2 and a blower 3. On either side of the front section of frame 1 are mounted cone-shaped rotating brushes 4, which are oriented downward and which draw together debris toward the center. Engine 2 drives blower 3 and rotating brushes 4. A hopper 6 is connected to a duct 5 of blower 3. Hopper 6 is disposed on frame 1 behind blower 3, and a debris evacuation opening 7 is disposed behind and below hopper 6. A filter 8 is also disposed in hopper 6. A flexible tube 9 is fitted into a side wall of hopper 6. The lower end of flexible tube 9 forms a suction opening 10. Flexible tube 9 is hung down from an appropriate position on frame 1. An engagement member 11 for engaging a lift bracket of a forklift vehicle is disposed toward the back of frame 1. When the rear portion of frame 1 is lifted up, the rotating brushes are separated from the ground. When motor 2 drives blower 3 and moves brushes 4, debris is moved through suction opening 10 and filter 8 disposed at an upper portion within hopper 6 collects the suctioned debris.

The rotating brushes 4 of the conventional large-scale cleaning vehicle are fixed to a rotating brush support member so that debris can be collected over a wider span than the width of a standard large-scale cleaning vehicle.

Conventionally, there have been no large-scale cleaning vehicles equipped with sprinkler devices or sound generating devices that give off warning sounds.

In conventional large-scale cleaning vehicles, an engine is used to drive the blower and the rotating brushes. Thus, the weight and the size of the cleaning vehicle is excessive. There are also problems in terms of cost. Furthermore, the vehicle could not make tight maneuvers.

In the conventional technology, when a rotating brush is fixed to the large-scale cleaning vehicle, debris can be collected only over a fixed width. Thus, cleaning operations cannot be performed in paths that are narrower than the width of the vehicle with the rotating brushes attached. Furthermore, since the rotating brush is always kept in contact with the ground or the like, it is possible for the brush to become deformed outward, thus obstructing the debris-collecting operation.

In conventional large-scale cleaning vehicles, it is possible to sweep up small pieces of trash with the brush, but large pieces of trash such as newspapers cannot be swept up with the brush. Thus, large pieces of trash cannot be cleaned.

In the cleaning operation performed by the conventional large-scale cleaning vehicle, the rotation of the rotating brush causes debris to blow up, thus disturbing the debris and also making debris collection less efficient. Often, the debris adhered to the ground cannot be removed by the rotating brush.

Furthermore in the conventional technology, operations are performed alone, and operators are not able to converse.

During cleaning, the noise from the rotating brush and the engine make the work monotonous and uninteresting, so that morale can be low.

Also, the operator can experience fatigue because it is always necessary to be careful for pedestrians. Thus, there is a need for the pedestrians themselves to be alerted so that accidents can be avoided.

OBJECTS AND SUMMARY OF THE INVENTION

It is an object of the present invention to provide a large-scale cleaning vehicle in which rotating brushes, sweeping brushes, and fans can be rotated without the use of an engine. The present invention can also make tight maneuvers. In the present invention, the operator of the forklift can evacuate the debris collected in the debris collection box while staying in the driver's seat. Furthermore, when the present invention is used on uneven surfaces, the claw and the bottom surface are kept from being damaged.

It is a further object of the present invention to improve debris-collecting efficiency and lifespan by attaching a rotating brush so that it can move freely both laterally and vertically, and so that it is fixed at a prescribed angle using a knock pin or the like. This makes it possible to perform debris collection over a desired range. When the rotating brush is not being used, the brush can be pulled up so that the efficiency of the brush is not decreased and the life-span is increased.

It is a further object of the present invention to provide a large-scale trash removal device that pushes large pieces of trash together. A large-scale trash removal device is attached to the front of the large-scale cleaning vehicle and can be raised when there is no large-scale trash. The height of the large-scale trash removal device can be adjusted according to the height of the ground with which it is in contact.

It is yet a further object of the present invention to provide a vehicle that sprinkles water to prevent the debris from rising up, thus removing debris adhered to the ground and also washing off the grime from the ground.

Lastly, it is a further object of the present invention to inform pedestrians that cleaning is taking place, maintain safety, provide peace of mind for the operator so that he or she can concentrate on the task at hand, and to make the cleaning operation, which tends to be monotonous, more enjoyable. This is achieved by attaching a sound generating device to the large-scale cleaning vehicle.

Briefly, a large-scale cleaning vehicle, for operation with a forklift, includes rotation brushes for sweeping debris toward a center of said cleaning vehicle, a sweeping brush for sweeping the debris into a debris collection box and a fan for pulling said debris into said debris collection box without the need for a motor in the cleaning vehicle. Each of the rotation brushes, the sweeping brush, and the fan are rotatably connected to a rear wheel of the cleaning vehicle such that when the cleaning vehicle is moved, the brushes and fan are rotated. The cleaning vehicle further includes a vertical adjustment for the rotation brushes to lift them when they are not needed, a lateral adjustment for the rotation brushes to adjust a width of sweeping, an audible warning for pedestrians, a water sprinkler system to aid in the cleaning process, and a large-scale trash removal brush mounted in front of the cleaning vehicle to push large-scale trash.

According to an embodiment of the present invention, there is disclosed, a large-scale cleaning vehicle pushed by a forklift vehicle comprising: a frame having roughly a cube shape, rotating brushes are attached downward at ends of a front portion of said frame, a rear wheel and a front wheel supporting said frame, a casing within said frame, said casing being roughly cube shaped and having a top surface and a rear side surface left open, a filter is connected to said top surface of said casing, a debris collection box is movably attached inside said casing, said debris collection box having a top surface and a rear side surface left open, a rotation of said rear wheel is transferred to said pair of rotating brushes disposed on the front of said large-scale cleaning vehicle, said rotation being transferred using a rotational transfer member, debris is swept toward a center and rear portion of a central portion of said large-scale cleaning vehicle, said rotation of said rear wheel is also transferred to a sweeping brush disposed at the rear of said large-scale cleaning vehicle using another rotational transfer member, debris swept by said rotating brush disposed on the front of said large-scale cleaning vehicle is swept up by said sweeping brush, said rotation of said rear wheel is also transferred to a fan using a rotational transfer member, said fan drawing said swept-up debris toward said filter, air cleaned by said filter is sent outward from said top surface of said casing, and said debris is collected in said debris collection box disposed below said filter.

According to another embodiment of the present invention, there is disclosed, a large-scale cleaning vehicle comprising: a vehicle body frame is supported by a pair of rear wheels and a single front-wheel caster, a fork insertion member is movably attached to said frame, brackets for supporting rotating brush attachment members are attached pointing downward to the bottom of the ends of said frame, said rotating brush attachment member, to which said rotating brush is attached pointing downward, is attached integrally to a connecting rod, an end of said connecting rod is movably mounted to a back of said bracket for supporting said rotating brush attachment member, a plurality of holes is formed on said bracket and said rotating brush attachment member, prescribed holes are made continuous and a fixing pin is inserted through said holes, and on said bracket is disposed a vertical rod for applying tension to a belt disposed across pulleys for rotating said rotating brush.

According to another embodiment of the present invention, there is disclosed, a large-scale cleaning vehicle with a water sprinkling device comprising: a vehicle body frame, a fork insertion member movably attached to said vehicle body frame supported by a pair of rear wheels and a single front wheel, a rotating brush support bracket is attached pointing downward on a bottom of said frame, a rotating brush attached to an end of said rotating brush support bracket, a water tank holding a volume of water mounted on said frame, a water sprinkler pipe is disposed across a front of said frame, said water sprinkler pipe having a plurality of nozzles, and said volume of water being connected to said water sprinkler pipe such that said water passes from said water tank through said water sprinkler pipe and out of said plurality of nozzles.

According to yet another embodiment of the present invention, there is disclosed, a cleaning vehicle, comprising: a frame having a front end and a rear end, an insertion member pivotally connected at said front end of said frame, said insertion member being shaped to receive a connecting member from a second vehicle which supplies a motive force to said cleaning vehicle; said frame being supported by a rear wheel and a front wheel, a rotating brush assembly connected to said front end of said frame, at least one rotating brush rotatably connected to at least one rotating brush support plate, said at least one rotating brush support plate being pivotally connected to said rotating brush assembly, said at least one rotating brush support plate being pivotable between an outer position and an inner position to adjust a width of sweeping, a sweeping brush positioned toward a rear end of said frame, a debris collection box hingably connected at a bottom of said tray, a fan being operationally connected to said debris collection box such that rotation of said fan pulls debris swept by said sweeping brush into said debris collection box, and each of said at least one rotating brush, said sweeping brush, and said fan being rotatably connected to said rear wheel such that said each of said at least one rotating brush, said sweeping brush, and said fan rotates when said rear wheel is rotated.

In the large-scale cleaning vehicle of the present invention, it is possible to rotate the rotating brushes, sweeping brushes, and fans without an engine. The rotation of the wheel shafts is used to rotate the rotating brushes, sweeping brushes, and fans.

Specifically, the large-scale cleaning vehicle of the present invention is pushed forward by a forklift vehicle. The accompanying rotation of the rear wheels of the large-scale cleaning vehicle is transferred to a shaft of a sweeping brush through the meshing of gears, thus rotating the sweeping brush. Furthermore, the rotation of the shaft of the sweeping brush is transferred to a shaft disposed on the front of the large-scale cleaning vehicle using a transfer member such as a belt or the like. The rotation of this shaft is then transferred to the shaft of a fan or a rotating brush using a transfer member such as a belt, thus rotating the fan or rotating brush.

The large-scale cleaning vehicle ofthe present invention is able to perform tight maneuvers. This is accomplished by movably disposing a fork fitting member on the upper surface of the large-scale cleaning vehicle.

The fork fitting member is formed with a shape that allows the fork of a forklift vehicle to be loosely inserted. The fork fitting member is movably attached to the upper surface of the large-scale cleaning vehicle of the present invention. The fork of the forklift vehicle is loosely inserted into the fork fitting member, and the large-scale cleaning vehicle is moved forward. The swinging of the fork fitting member swings the large-scale cleaning vehicle to the left and right, thus allowing the large-scale cleaning vehicle to make tight maneuvers.

The large-scale cleaning vehicle of the present invention makes it possible for the forklift operator to eject the debris collected in the debris collection box without getting up from the driver's seat. A ratchet that can move up and down is attached to a frame, which forms the vehicle body of the large-scale cleaning vehicle. The bend in the ratchet is suspended at the bottom ofthe debris collection box, and the other end of the ratchet is connected to a wire. The wire is operated by the forklift operator to eject the debris held in the debris collection box.

The top side and one of the side walls of the debris collection box in the frame are left open. The debris collection box is movably connected to the frame. The opened side wall and the bottom surface of the opposite wall are suspended by the hooked portion of the ratchet. When the forklift operator pulls the wire, the ratchet is drawn up. The debris collection box, which is suspended from the hooked portion of the ratchet, is swung, and the debris held in the debris collection box is ejected outside from the open side.

When the large-scale cleaning vehicle of the present invention is used on uneven ground, the claw disposed on the debris collection box and the bottom surface of the debris collection box are prevented from being damaged. A caster disposed on a side surface ofthe debris collection box comes into contact with the ground before the claw or the bottom surface of the debris collection box does. This protects the claw and the bottom surface of the debris collection box.

Casters are movably attached on the two side surfaces of the debris collection box and are connected with a coil spring to the side surfaces. A stopper is disposed on the side surface of the debris collection box in order to keep the lower edge of the caster slightly closer to the ground than the claw and the bottom surface of the debris collection box. Since the caster is always kept closer to the ground than the claw and the bottom surface of the debris collection box, the large-scale cleaning vehicle of the present invention can be used over uneven surfaces without damaging the claw or the bottom surface of the debris collection box.

A rotating brush support plate is attached pointing downward to the bottom part of the vehicle body frame. On the inner surface of the rotating brush support plate is attached a pair of upper and lower brackets to hold the upper and lower portions of a rotating brush attachment member. A connecting rod is formed integrally with the rotating brush attachment member. The end of the connecting rod is movably mounted into the back section of the bracket, and the connecting rod is passed through holes formed on the bracket and the rotating brush attachment member. The connecting rod is fixed between the rotating brushes using a fixing pin. This allows the rotating brushes to move to the left and right.

Hollow caster attachment legs are attached downward to the vehicle body at a central position between the rotating brushes, which are attached downward on the ends of the vehicle body frame at the front of the large-scale cleaning vehicle. The rotatable front-wheel caster is mounted downward on a support plate. The support plate is fixed to the bottom end of a shaft which is rotatably fitted within the lower portion of the caster attachment leg so that it can slide up and down. A bracket is disposed on the support plate, and the bent portion of a foot lever formed in a shape of a bell crank is movably mounted to the bracket. A connecting rod connects one end of the foot lever and the caster attachment leg. A tension spring elastically supports the connecting point between the connecting rod and the caster attachment leg and the connection point between the foot lever and the bracket. Upward and downward motions of the foot lever allow the rotating brush to move up and down.

In the large-scale trash removal device of the present invention, a largescale trash collection brush or an elastic plate such as a rubber plate is attached to the large-scale cleaning vehicle so that it can be lifted up or down.

Furthermore, a water tank is mounted on top of the frame of the large-scale cleaning vehicle. A nozzle is disposed on the front of the frame, and a water sprinkler pipe is disposed across the frame to serve as a water sprinkler device for the large-scale cleaning vehicle. A sensor and a sound generating device is attached and the sound generating device is activated when the fork is attached or removed.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
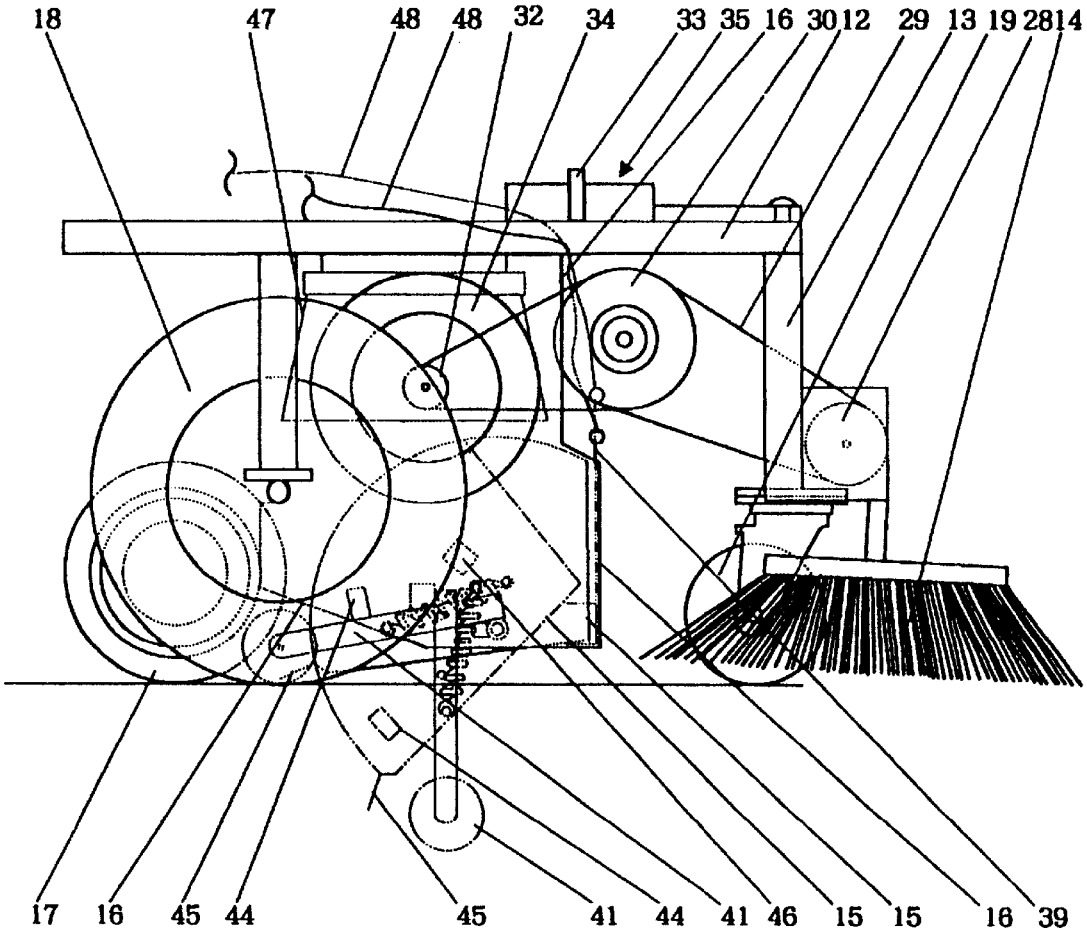
FIG. 1 is an elevational side-view of a large-scale cleaning vehicle according to the present invention.

Referring to the drawings, the following is a description of the preferred embodiments of the present invention.

Figure 2:
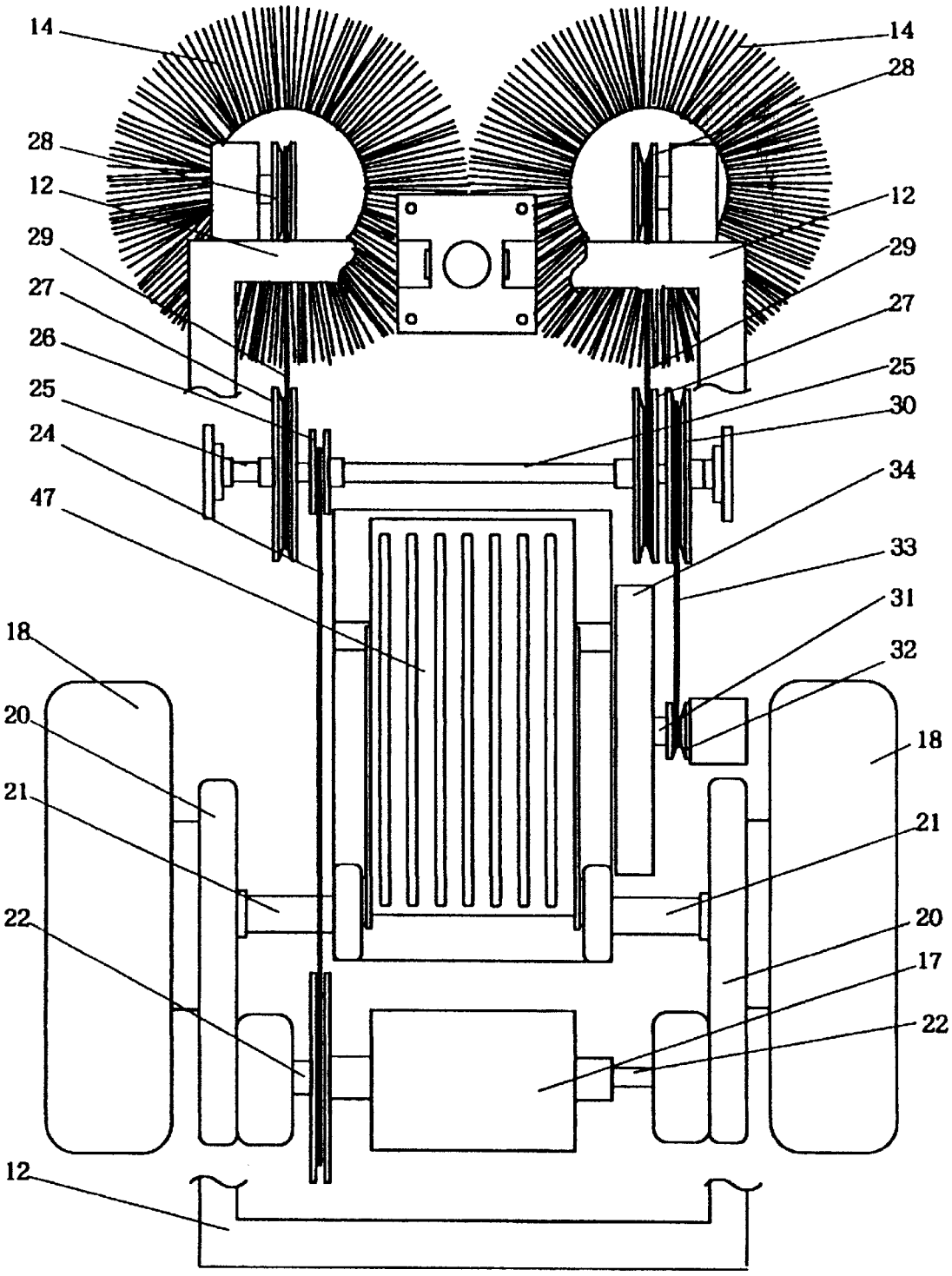
FIG. 2 is a plan drawing of the large-scale cleaning vehicle of FIG. 1.

Referring to FIGS. 1 and 2, a frame 12 forms the upper section of a large-scale cleaning vehicle 75. Frame 12 is supported at three points by a pair of rear wheels 18 and a single front wheel caster 19.

Frame 12 is rectangular in shape. Rotating brush support plates 13 are attached pointing down at the left and right ends of a front portion of frame 12. A rotating brush 14 is attached to the end of each rotating brush support plate 13. A roughly cube-shaped casing 16 is connected to frame 12. Casing 16 houses a debris collection box 15. A sweeping brush 17 is rotatably connected at a rear side of frame 12. The upper and rear surfaces of debris collection box 15 that face sweeping brush 17 are left open.

A shaft 21 of rear wheel 18 is connected to a gear held in a gear box 20. Another gear that meshes with this gear is connected to a shaft 22 of sweeping brush 17. Gear box 20, or another type of rotational transfer member, allows the rotation of rear wheel 18 to be transferred to sweeping brush 17 via the gears so that sweeping brush 17 is rotated. The gears are meshed so that rear wheel 18 and sweeping brush 17 rotate in opposite directions.

Shaft 22 of sweeping brush 17 is attached to a pulley 23. A belt 24 is reeved about pulley 23 and another pulley 26. Pulley 26 is disposed on a shaft 25 at the front of the large-scale cleaning vehicle and supported by frame 12. Shaft 25 is long enough to go from the left side surface to the right side surface of large-scale cleaning vehicle 75. Including pulley 26, four pulleys are disposed on shaft 25.

Pulleys 27, disposed near the left and right ends of shaft 25 serve as rotational transfer members for rotating brushes 14. For each rotating brush 14, a belt 29 is bridged across pulley 27 and a pulley 28. Pulley 28 is attached to rotating brush support plate 13 disposed toward the front of frame 12. The rotation of pulley 28 is transferred to the shaft of rotating brush 14, causing rotating brush 14 to rotate.

Shaft 25 further includes a pulley 30. A belt 33 is reeved about pulley 30 and a pulley 32, which is connected to a fan shaft 31. Fan shaft 31 is supported by frame 12. The rotation of shaft 27 is transferred to fan shaft 31. A fan 34, which is connected to fan shaft 31, is thereby rotated.

Figure 5:
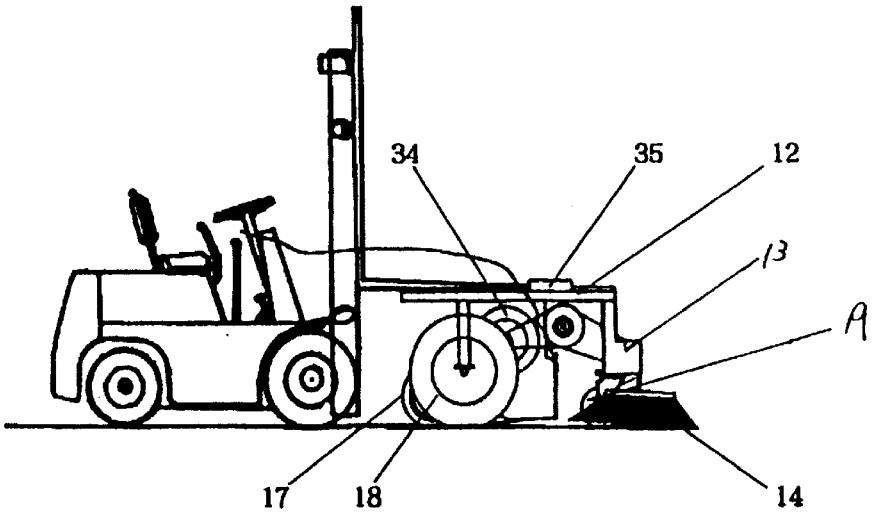
FIG. 5 is an elevational side-view showing how the large-scale cleaning vehicle of the present invention is used.
Figure 6:
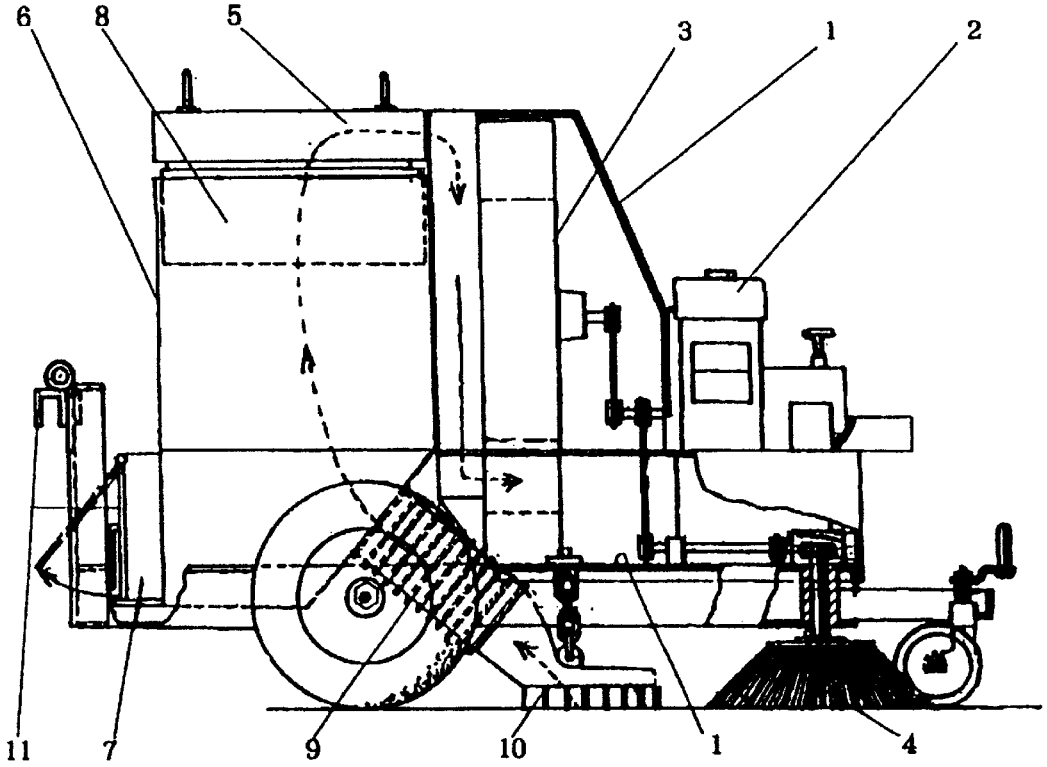
FIG. 6 is an elevational side-view showing an example of conventional large-scale cleaning machine.

Referring now also to FIG. 5, a forklift vehicle 91 pushes large-scale cleaning vehicle 75 of the present invention. As forklift vehicle 91 pushes large-scale cleaning vehicle 75, the rotation of rear wheels 18 causes left and right rotating brushes 14 to rotate. The rotation of rotating brush 14 collects debris toward the center of large-scale cleaning vehicle 75. Brush 17, which is also rotated by the rotation of rear wheels 18, sweeps up the collected debris. As brush 17 sweeps up the collected debris, the swept debris is drawn to debris collection box 15 by fan 34, which is also rotated by the rotation of rear wheels 18. In casing 16, a filter 47 is attached to a position corresponding to the upper surface of debris collection box 15. Air containing the debris drawn in by fan 34 is cleaned by filter 47, and the debris drops into debris collection box. The air which is drawn by fan 34, now free of debris, leaves filter 47 and is dispersed outside via the open upper surface of casing 16.

Figure 3:
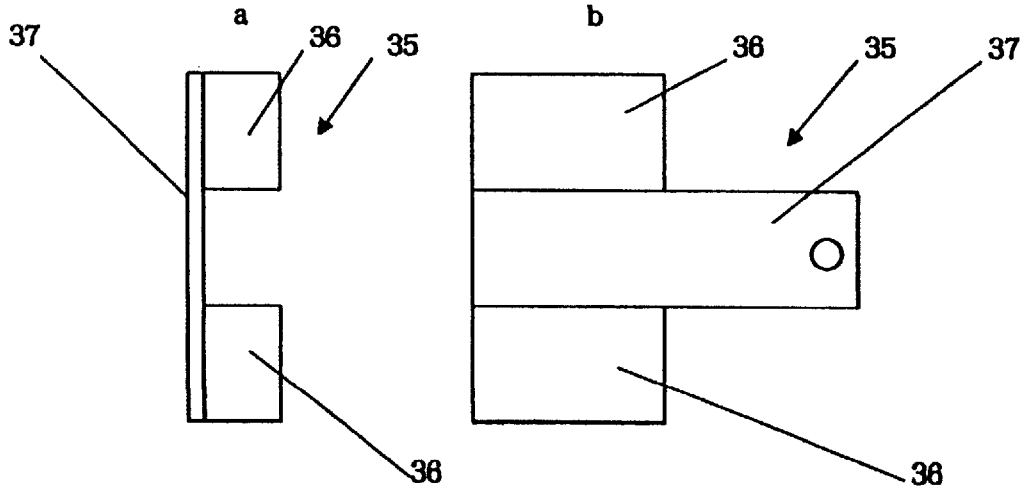
FIG. 3*a* is a side-view of a fork fitting member of the large-scale cleaning vehicle of FIG. 1, viewed from the left side.
FIG. 3*b* is a front-view of the fork fitting member of FIG. 3*a*.

Referring now to FIGS. 1, 3*a*, and 3*b*, a fork-fitting member 35 of large-scale cleaning vehicle 75 comprises: a box 36 into which the fork of forklift vehicle 91 is fitted and which has one of its side walls left open; and a support plate 37 for mounting box 36. The front of support plate 37 and the front of frame 12 are rotatably connected by a pin. Fork-fitting member 35 swings over side plates disposed on the left and right sides of frame 12. Also, a support plate is disposed on fork fitting member 35 across the width of frame 12 so that fork fitting member 35 is prevented from arching upward.

Figure 4:
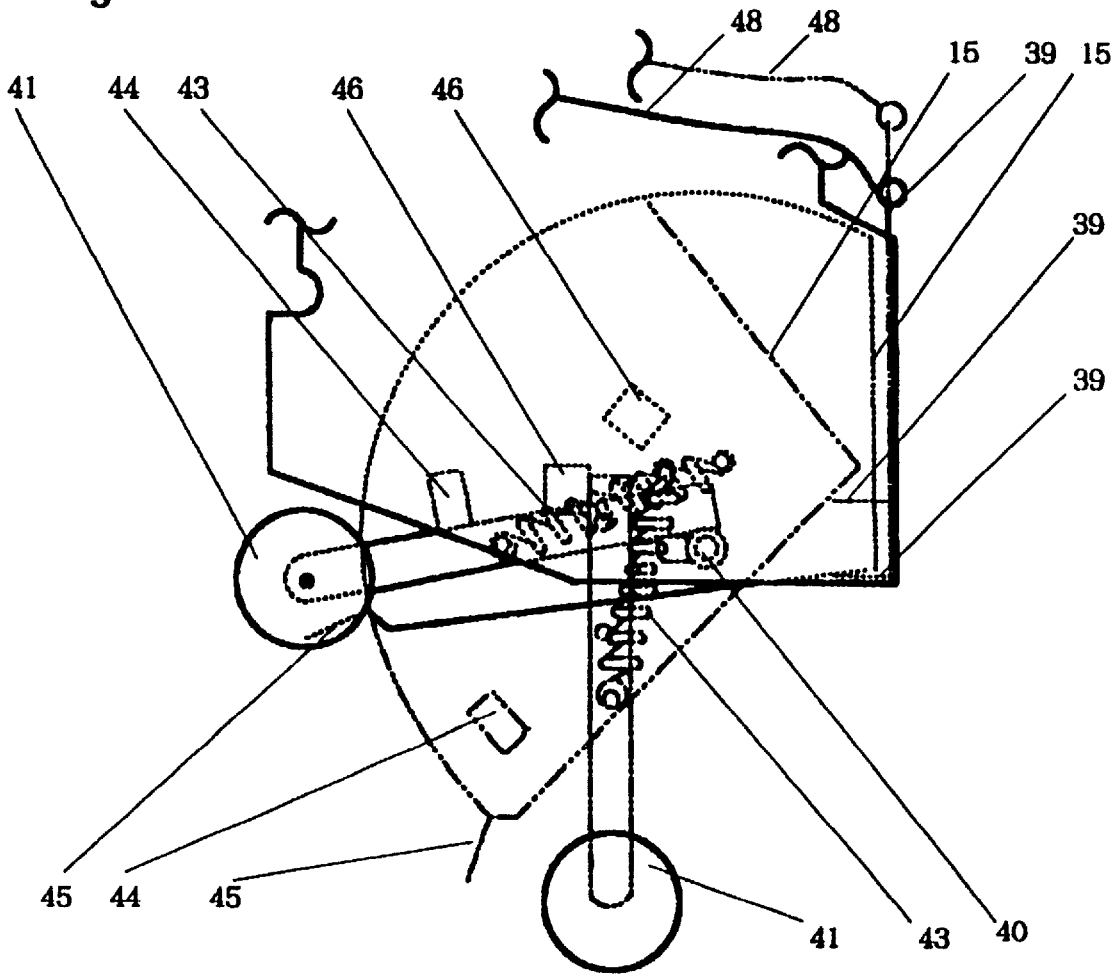
FIG. 4 is an enlarged, schematic diagram of the area around a debris collection box of the large scale cleaning vehicle of the present invention.

Referring now to FIGS. 1, 2, and 4, a claw 45 is disposed on the open side of debris collecting box 15 toward sweeping brush 17. Debris collecting box 15 is disposed within casing 16 and attached to casing 16 so that it can swing freely around a pin 40. The lower surface of debris collection box 15 is suspended by a hook-shaped ratchet 39, and the upward and downward motions of ratchet 39 allow debris collection box 15 to swing.

Casters 41 are loosely inserted in the left and right gaps between debris collection box 15 and casing 16. Casters 41 are attached so that they can pivot around debris collection box 15 and pin 42. Casters 41 are connected to debris collection box 15 via a coil spring so that upward tension is applied to casters 41. A stopper 44 is disposed on debris collection box 15 in order to keep caster 41 at a fixed position as it is pulled up. Stopper 44 is disposed at a position that stops caster 41 when its lower edge is slightly below (i.e. toward the ground) the bottom surface and claw 45 of debris collection box 15. When debris collection box 15 is pulled upward with ratchet 39, stopper 44 pushes caster 41 downward. If ratchet 39 is not pulling debris collection box 15 upward, an upward force is acting on caster 41 from coil spring 43. Referring specifically to FIG. 4, the force is applied clockwise. However, when stopper 44 pushes caster 41 down to the fixed position, i.e. past the position where caster 41 and coil spring 43 are parallel to each other, coil spring 43 applies a downward force to caster 41. The force is applied counterclockwise. Stopper 46 is disposed on debris collection box 15 so that when caster 41 is being pulled down, it stops at a position where it is positioned roughly perpendicular to the ground. Thus, the lower end of caster 41 will always be further toward the ground than the bottom surface of debris collection box 15 and claw 45. Thus, the bottom surface of debris collection box 15 and claw 45 are prevented from damage.

The following is a description of the embodiment of the present invention, wherein a rotating brush is attached so that it can swing freely.

Referring to FIG. 5, large-scale cleaning vehicle 75 pushed by forklift vehicle 91 rotates rotating brush 14. A frame 12 forms the upper section of the large-scale cleaning vehicle. Frame 12 is supported at three points by a pair of rear wheels 18 and a single front wheel caster 19. Fork fitting member 35 is disposed on frame 12. The fork of forklift vehicle 91 is inserted into fork fitting member 35 to push large-scale cleaning vehicle 75 forward.

Figure 7:
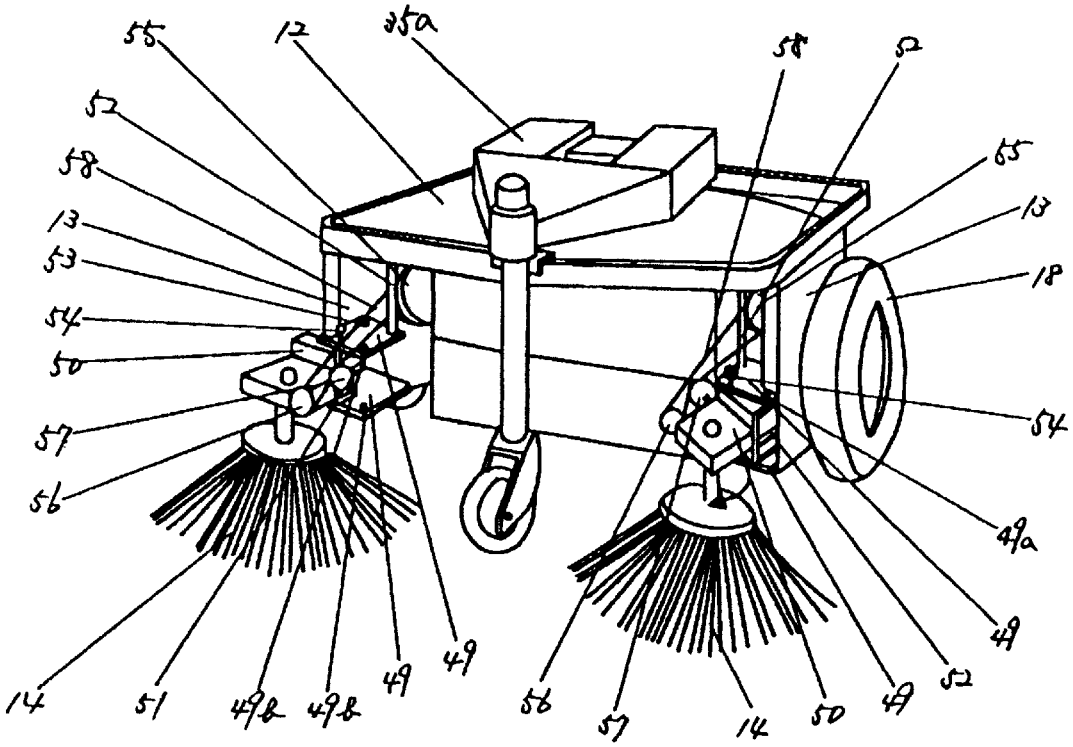
FIG. 7 is a perspective view of an embodiment of the large-scale cleaning vehicle of the present invention.

Referring now to FIG. 7, there is shown an enlarged perspective drawing of the main elements of large-scale cleaning vehicle 75 of the present invention. Left and right rotating brush support plates 13 are attached downward below the left and right ends of frame 12. Upper and lower brackets 49 are fixed horizontally to the inner sides of support plates 13.

A rotating brush attachment member 50 is formed in the shape of a square "C". Rotating brush attachment member 50, to the front of which rotating brush 14 is attached pointing downward, is loosely inserted into upper and lower brackets 49. The base end of a connecting rod 51 is connected to rotating brush attachment member 50, and the end of connecting rod 51 is movably mounted into a bolt 53 disposed toward the back of upper and lower brackets 49. Thus, rotating brush attachment member 50 and rotating brush 14 can be swung to the left and right about bolt 53.

Figure 8:
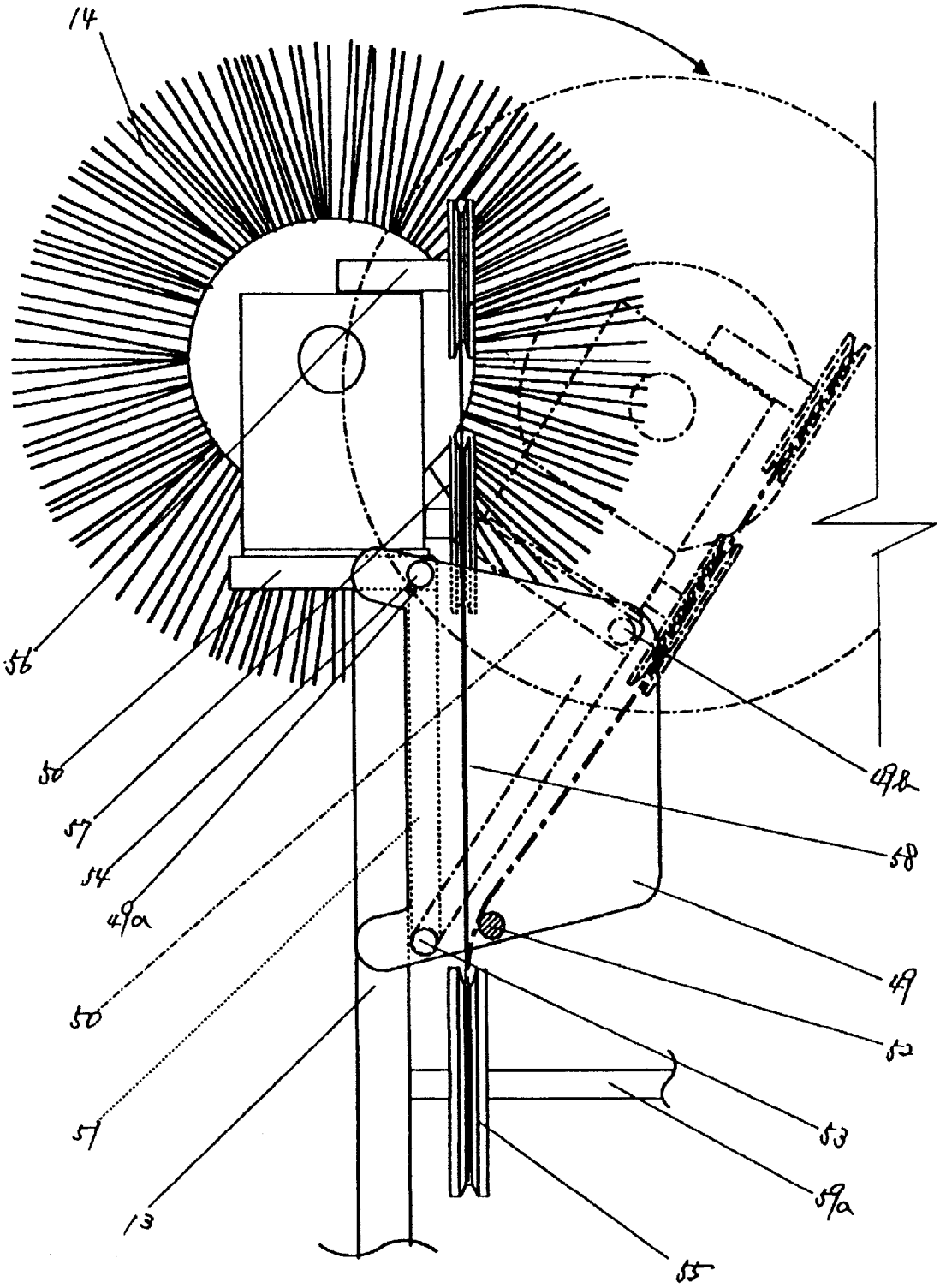
FIG. 8 is a schematic plan drawing of one of the rotating brushes of the large-scale cleaning vehicle of FIG. 7.
Figure 9:
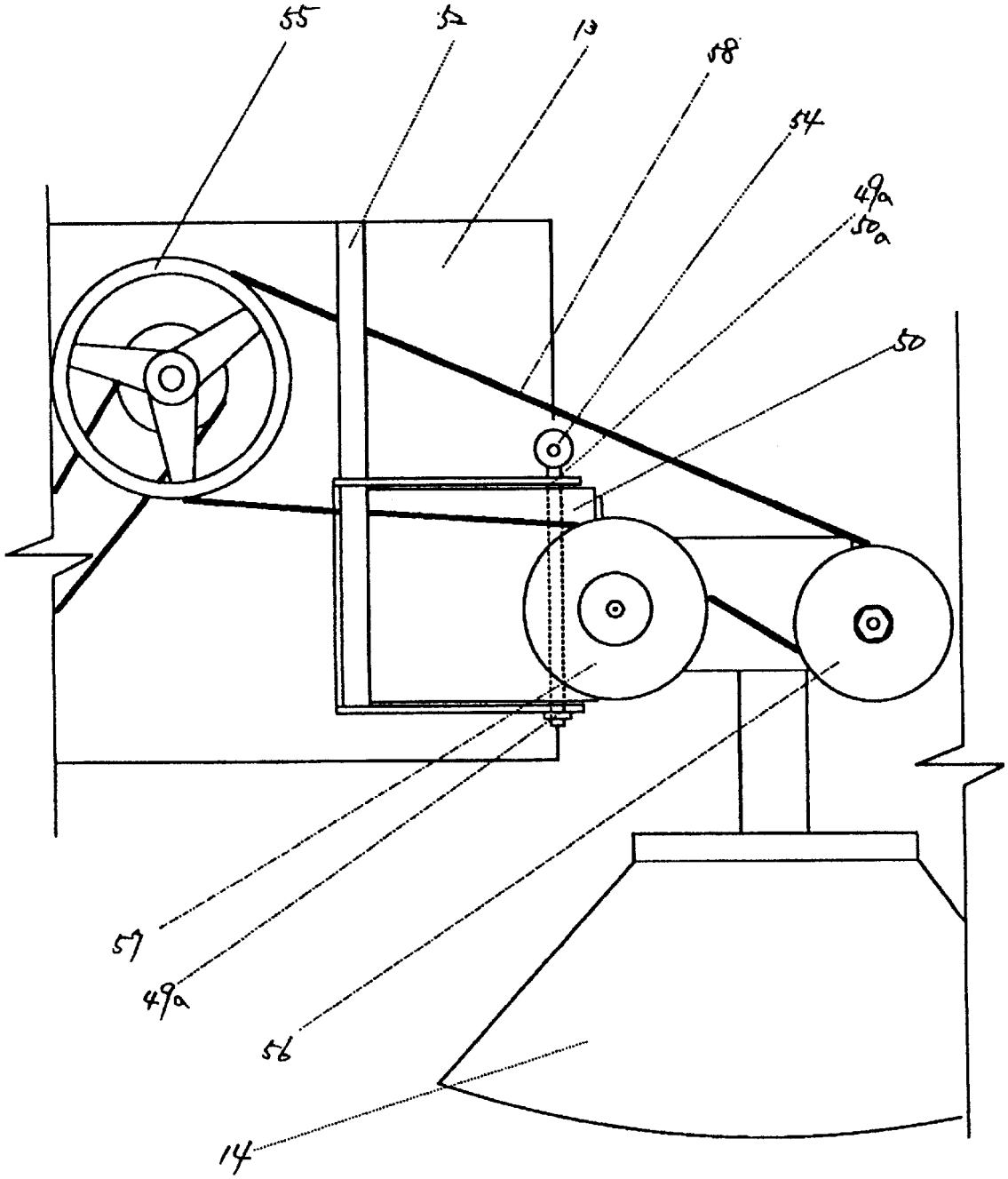
FIG. 9 is a schematic diagram viewed from the side of the large-scale cleaning vehicle of FIG. 7.

Referring now also to FIGS. 8 and 9, openings 49*a*, 49*b* are disposed at the ends of upper and lower brackets 49. Openings 49*a* and 49*b* both lie on the circumference of a single circle centered about bolt 53 and are positioned at equivalent positions on upper and lower brackets 49. Holes 50*a* are also formed at corresponding positions in the upper and lower surfaces (i.e. the horizontal sides) of rotating brush attachment member 50. When hole 50*a* and hole 49*a* of are aligned, knock pin 54 is inserted and fitted through the aligned holes. Knock pin 54 fixes brush attachment member 50 to rotating brush support plate 13.

When rotating brush 14 is to be moved inward, knock pin 54 is disengaged from the aligned holes and rotating brush attachment member 50 is rotated inward about bolt 53 to align hole 50*a* and hole 49*b*. Then, knock pin 54 is inserted and fitted again to fix brush attachment member 50 to rotating brush support plate 13.

A primary drive pulley 55 is fixed to shaft 17*a* of sweeping brush 17 disposed behind rear wheel 18. Driven pulley 58 is attached in front of rotating brush attachment member 50 and serves to transfer the drive force to rotate rotating brush 14. The drive force from the rotation of rear wheel 18 is transferred to rotating brush 14 via belt 58, which bridges primary drive pulley 55 and driven pulley 56. Referring momentarily to FIG. 9, a tension pulley 57 is also shown.

Furthermore, the motion of rotating brush 14 and rotating brush attachment member 50 causes driven pulley 56 and tension pulley 57 to move. When this happens, belt 58 is prevented from becoming slack by disposing a vertical rod 52 between the lower portion of frame 12 and bracket 49 and inward from belt 58.

The following is a description of the foot lever for raising the rotating brush. Referring to FIG. 1, vehicle frame 12 of the cleaning vehicle is formed as a square and is supported at three points by a pair of rear wheels 18 and a single front wheel 19.

A caster attachment leg 90 is attached downward at a central portion of the front of vehicle frame 12. A shaft 59 is inserted in caster attachment leg 90 from the bottom. Shaft 59 is fitted so that it can slide up and down and rotate freely. Front caster 19 is mounted downward at the lower portion of shaft 59 and is fixed integrally to a support plate 60, which forms a brim.

Figure 10:
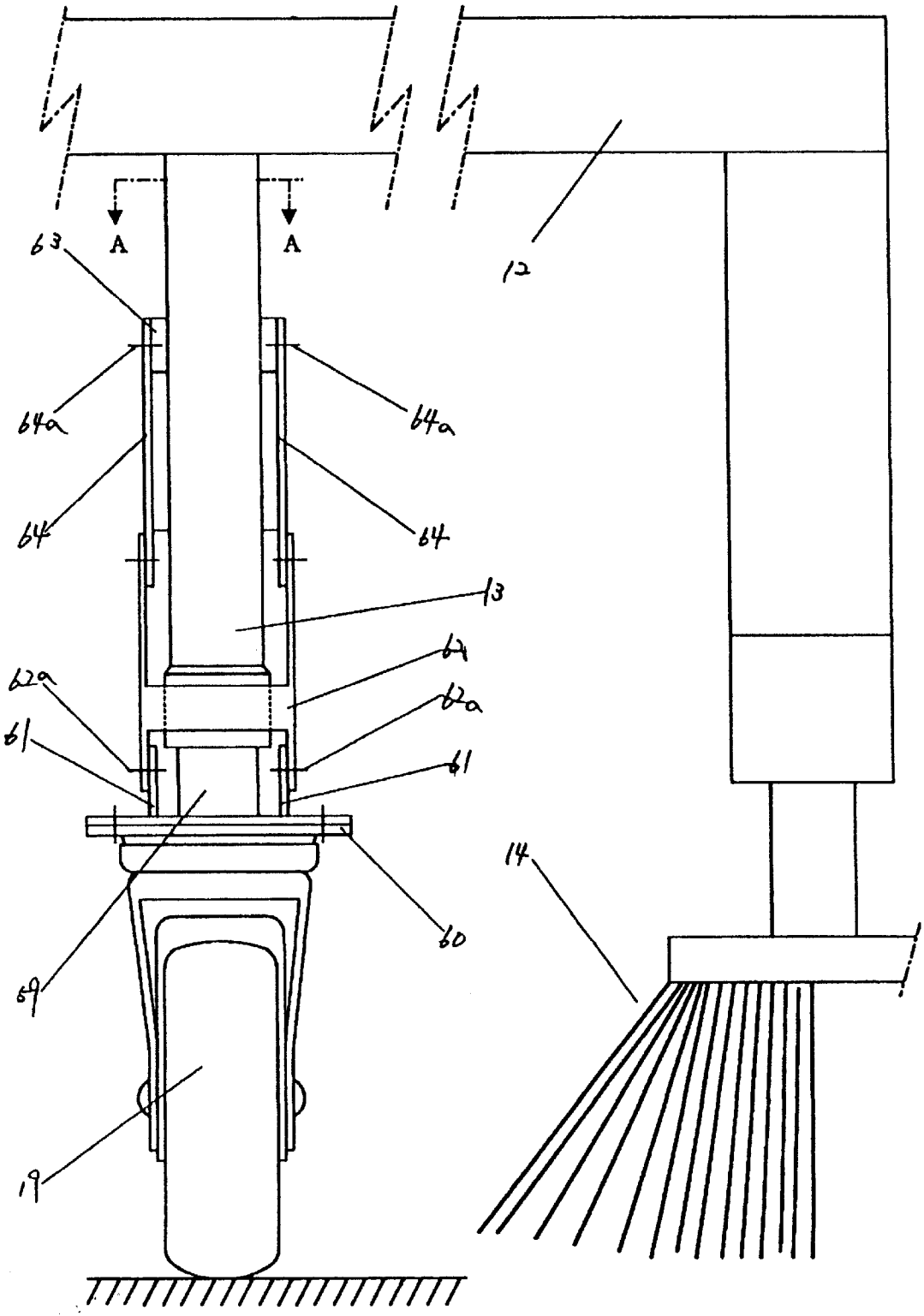
FIG. 10 is a partial elevational front-view of the main elements of the large-scale cleaning vehicle of the present invention with a foot lever for lifting up the rotating brush.

Referring to FIG. 10, there is shown a front-view drawing showing front wheel caster 19 and rotating brush 14 attached to the front part of vehicle frame 12. A rotating brush 14 is attached facing down to each end of vehicle frame 12, but only one rotating brush is shown in the drawing. Support plate 60, which is formed by overlapping two plates, and front wheel caster 19 is rotatably mounted on lower support plate 60. A pair of brackets 61 is disposed on the upper surface of upper support plate 60.

Figure 11:
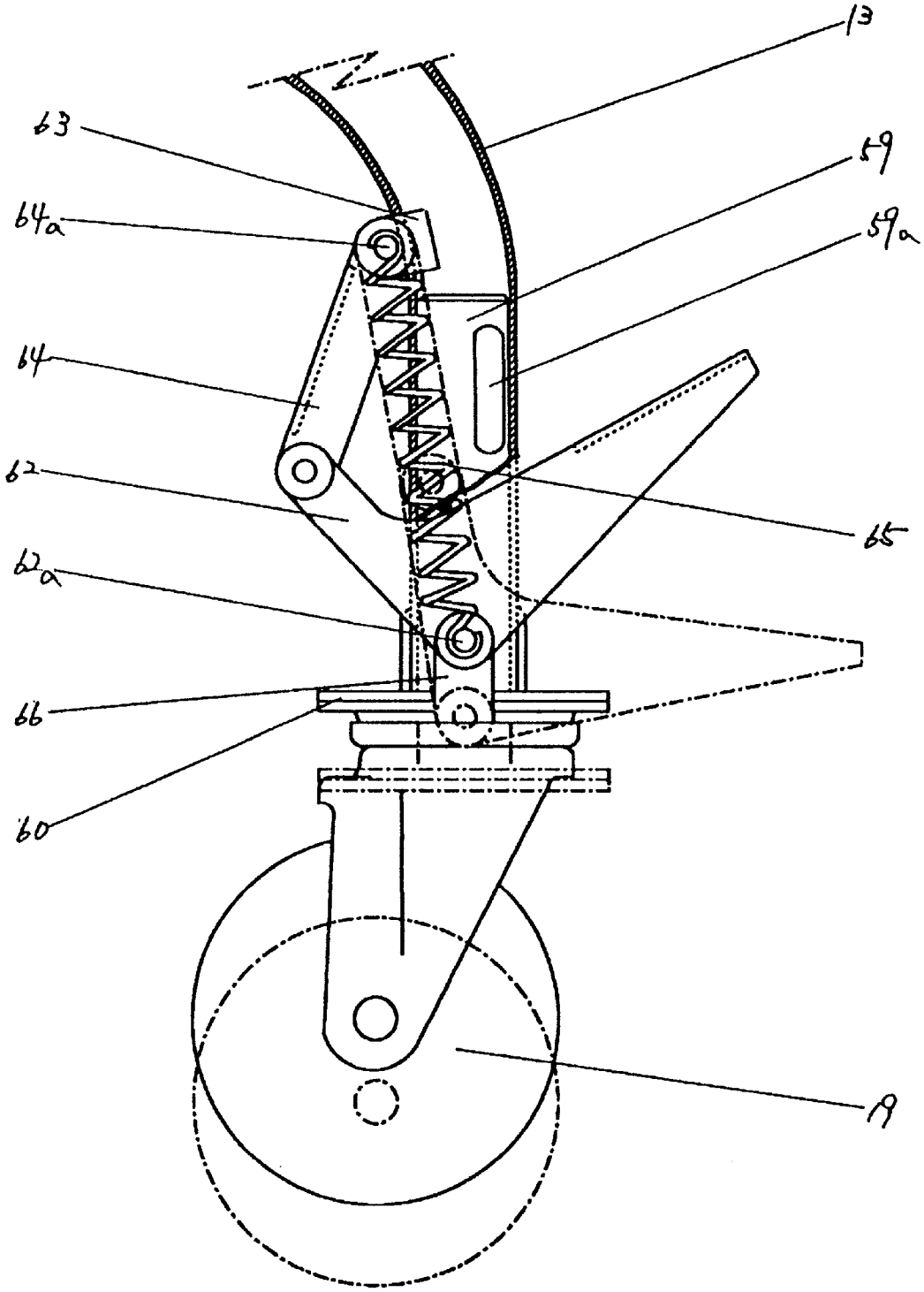
FIG. 11 is an elevational side-view of the main elements of the large-scale cleaning vehicle of the present invention with a foot lever for lifting up the rotating brush of FIG. 10.

Referring now also to FIG. 11, support plate 60 of front wheel caster 19 is fixed integrally to the lower surface of shaft 59. A pair of brackets 61 is disposed on the upper surface of support plate 60, which projects out from the perimeter of shaft 59 like a brim. A bell-crank foot lever is movably mounted into these brackets with a pin 62*a*. Foot lever 62 is U-shaped when viewed from the side.

One end of foot lever 62 is connected to a connecting member 63 via a connecting rod 64 and a connecting pin 64*a*. Connecting member 63 is supported on caster attachment leg 90.

A tension spring 65 is disposed between a connecting point 64*a* and a connecting point 62*a*. Connecting point 64*a* is the connection between connecting member 63 and connecting rod 64. Connecting point 62*a* is the connection between the bend in foot lever 67 and bracket 61.

Figure 12:
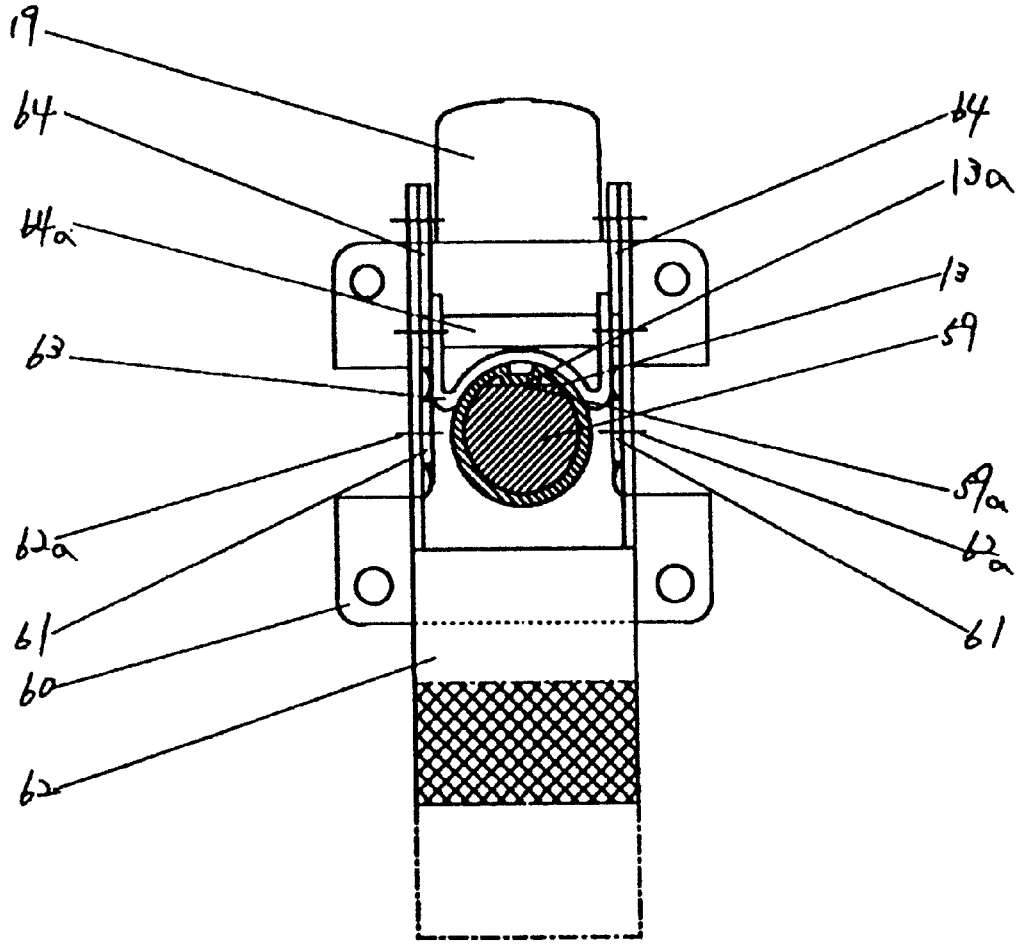
FIG. 12 is a cross-sectional view along the XII—XII line in FIG. 10.
Figure 13:
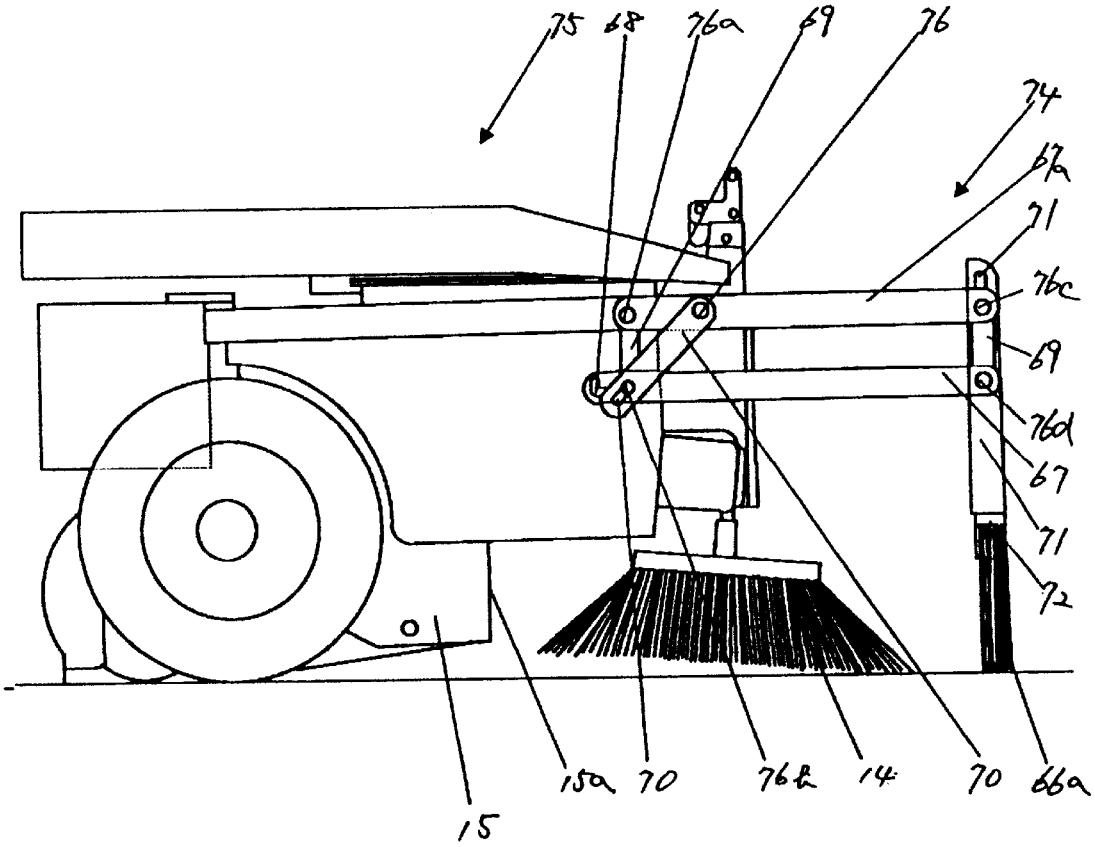
FIG. 13 is an elevational side-view showing another embodiment of the present invention with a large-scale trash removal device.

Referring now to FIG. 12, to prevent rotation of shaft 59, an inward projection 90*a* is formed on a section of caster attachment leg 90. A flat end surface 59*a* is formed on a section of shaft 59 to come into contact with inward projection 90*a*.

Referring again also to FIG. 11, the dotted line shows how the foot lever operates. When foot lever 62 is kicked up or down, support plate 60, which is connected via bracket 61 to foot lever 62, is moved up and down. Likewise, shaft 59 and front wheel 19, which are fixed to support plate 60, are also moved up and down. This causes rotating brush 14, which is integrally connected with caster attachment leg 90 to vehicle frame 12, to move up and down.

Figure 14:
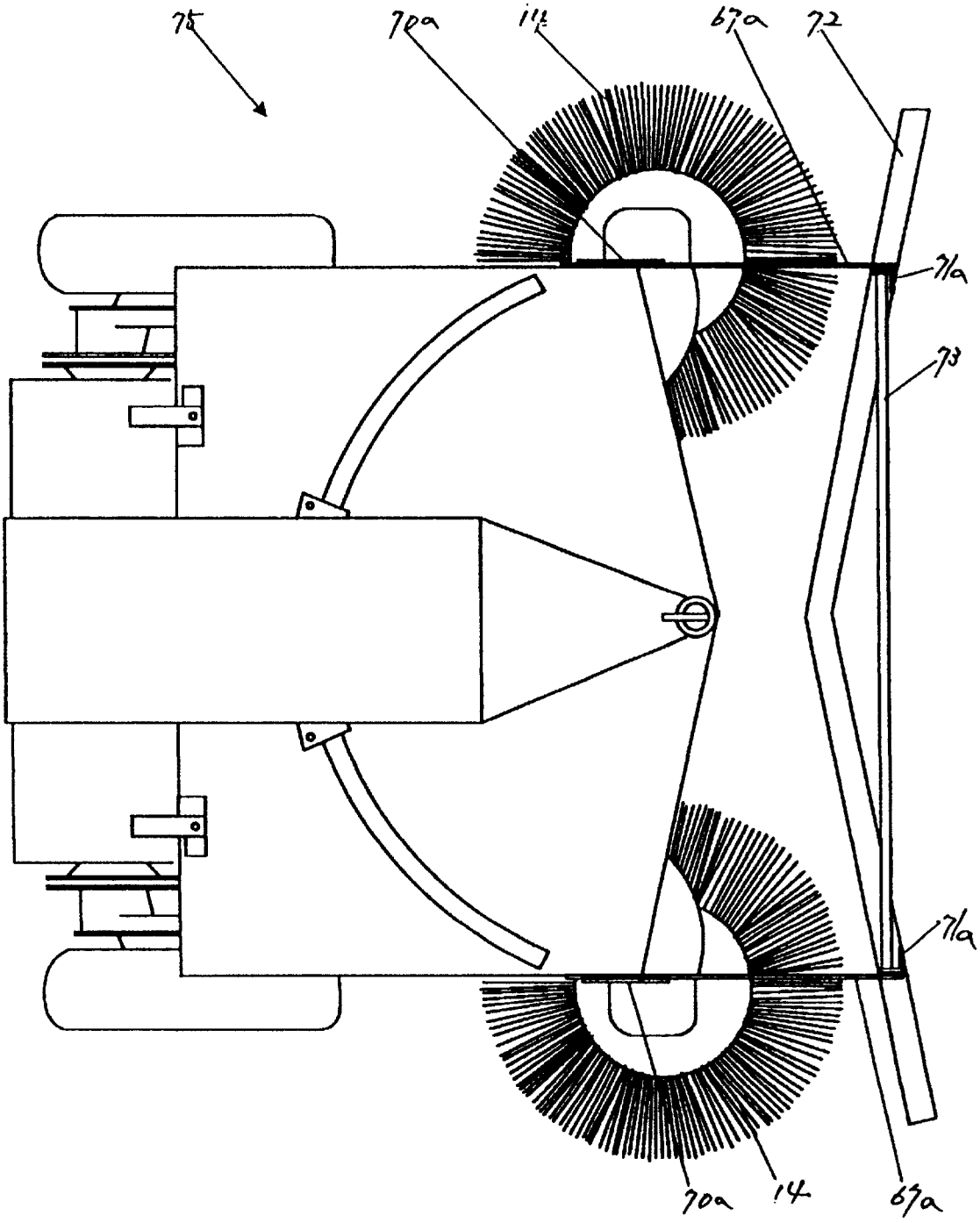
FIG. 14 is a plan drawing showing how the large-scale trash removal device of FIG. 13 is used.
Figure 15:
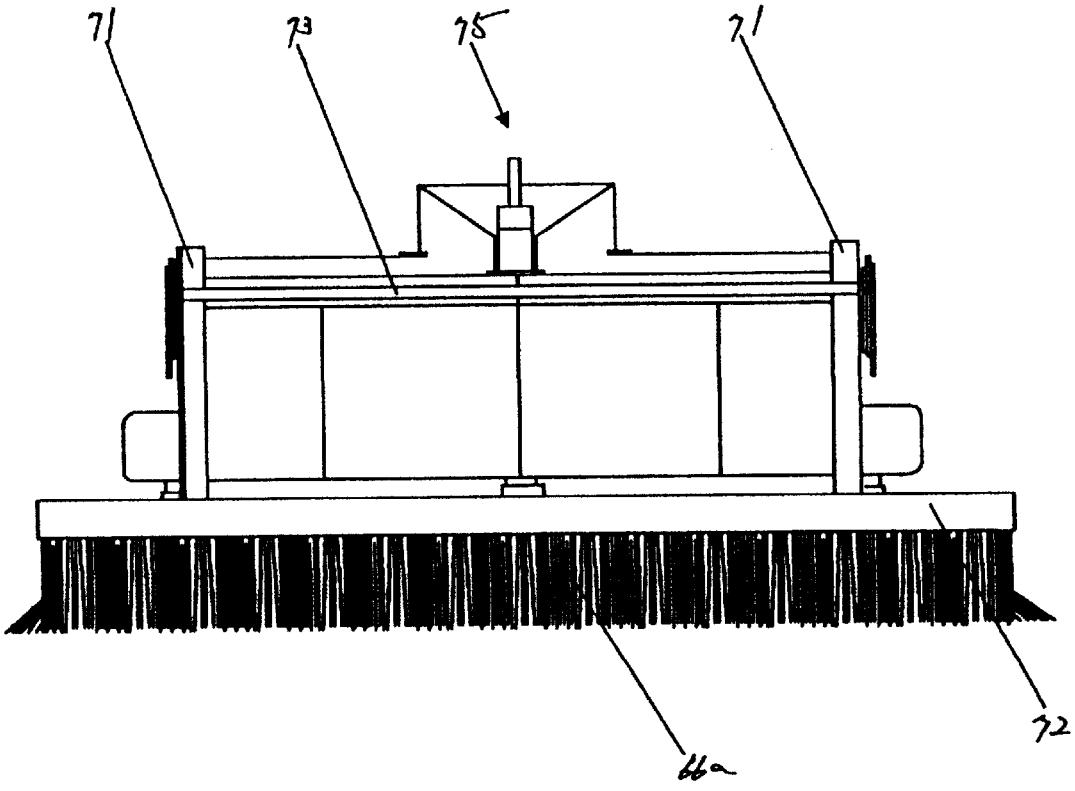
FIG. 15 is an elevational front-view, showing how the large-scale trash removal device of FIG. 13 is used.

The following is a description of the preferred embodiments of a large-scale trash removal device attached to a large-scale cleaning vehicle. Referring to FIGS. 13–15 and 18–19, a large-scale trash removal device 74 comprises: a brush 66*a*; arms 67*a*, 67*b*; support rods 69*a*, 69*b*; a connecting rod 70*a*; a vertical rod 71; a squeezing piece 72; and a connecting rod 73. Referring to FIG. 14, large-scale trash removal device 74, comprising these members, is attached to a large-scale cleaning vehicle 75 so that it projects toward the front of large scale cleaning vehicle 75.

Large-scale trash removal device 74 and large-scale cleaning vehicle 75 are connected via liftable arms 67*a*, 67*b* around shafts 76*a*, 76*b*. The ends of arm 67*a* and arm 67*b* are supported by supporting rods 69*a*, 69*b* so that the members are formed roughly in the shape of a rectangle.

The ends of support rod 69*a* are fixed to large-scale cleaning vehicle 75 via shafts 76*a*, 76*b*. Arms 67*a*, 67*b* are attached to support rod 69*a* so that they can be lifted up and down. Arms 67*a*, 67*b* and support rod 69*b* are fixed to shafts 76*c*, 76*d* at the end opposite from the large-scale cleaning vehicle. Support rod 69*b* is fixed so that it overlaps with vertical rod 71*a*.

Lower arm 67*b* is longer than upper arm 67*a*, and a hooked hole 68 is disposed on lower arm 67*b* into which 76*b* is loosely inserted. Support 69*b* fixes the relative positioning of arm 67*a* and one end of arm 67*b*. Support arm 69*a* is fixed to large-scale cleaning vehicle 75. Thus, when arms 67*a*, 67*b* are lifted up, a force is applied to arm 67*b* to make it move to the right and up.

Arms 67*a* and arm 67*b* are also supported in a diagonal orientation by connecting rod 70*a*. Connecting rod 70*a* and arm 67*a* are rotatably attached around shaft 76*e*. A slot 70*b* is disposed at a lower portion of connecting rod 70*a*, which supports arms 67*a*, 67*b*. Shaft 76*b* is loosely inserted into slot 70*b*. Since the relative positioning of arm 67*a* and one end of arm 67*b* is fixed by support rod 69*b*, connecting rod 70*a* is raised when arms 67*a*, 67*b* are lifted up. This makes it possible to upwardly displace connecting rod 70*a*.

Vertical rod 71*a* on the right side and vertical rod 71*a* on the left side are connected in the shape of an "H" by connecting rod 73. The lower end of vertical rod 71 is opened downward. Vertical rod 71 is attached to a squeezing piece 72, which is formed with a cavity oriented toward the large-scale cleaning vehicle on the side facing the ground. A brush 66*a* is inserted into squeezing piece 72. If an elastic plate 66*b* made from a rubber plate or the like is used, elastic plate 66*b* (not shown in FIGS. 13–15 or 18–19) is inserted into squeezing piece 72 in the same manner.

Slots 71*b*, 71*b* are disposed on an upper and lower section of vertical rod 71*a*. By changing the fixing position between arms 67*a*, 67*b* and support rod 69*b*, it is possible to adjust the height of brush 66*a*. This makes it possible to have the brush position correspond with the height of the ground. Arms 67*a*, 67*b* are fixed via shafts 76*c*, 76*d*.

Figure 16:
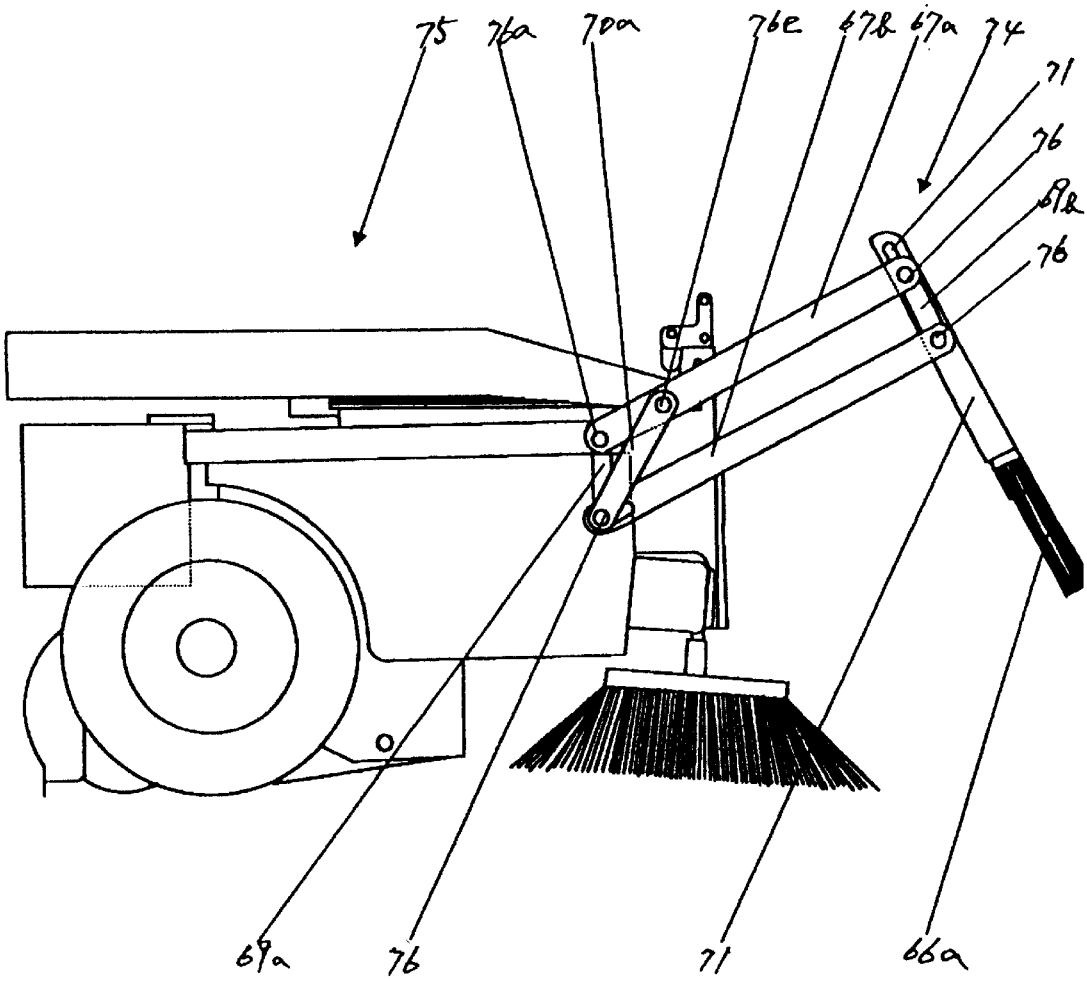
FIG. 16 is an elevational side-view showing the large-scale trash removal device of FIG. 15 in a raised state.
Figure 20:
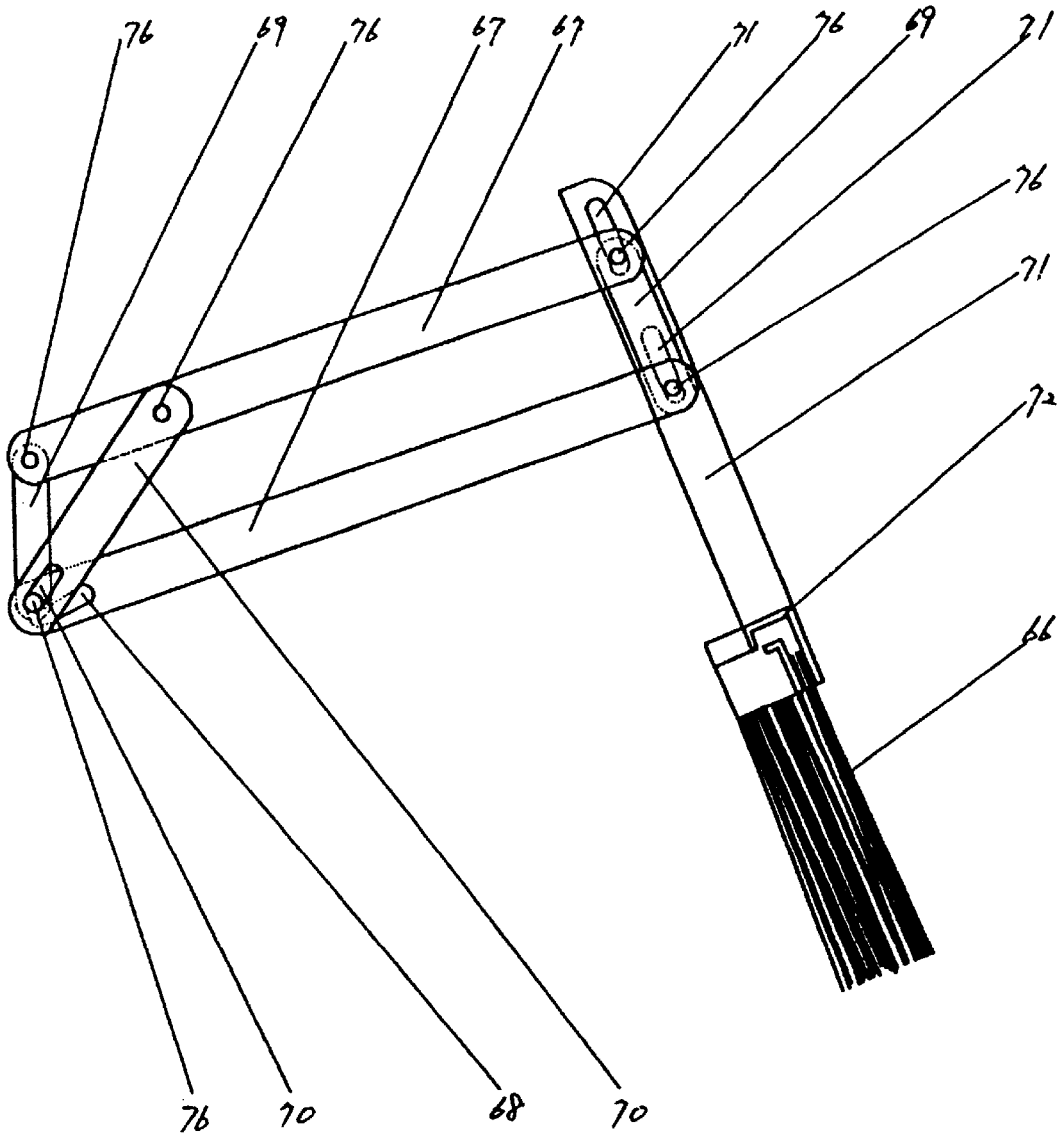
FIG. 20 is an elevational side-view showing the large-scale trash removal device of FIG. 19 in a raised state.

Referring to FIGS. 16 and 20, when large-scale trash removal device 74 is not being used, it is possible to draw it upward so that brush 66*a* is kept away from the ground. When arms 67*a*, 67*b* are lifted up around shafts 76*a*, 76*b*, arm 67*b* is drawn diagonally, to the up and to the right in FIG. 20. The hooked section of hooked hole 68 disposed on arm 67*b* is fitted with shaft 76*b*. This maintains the raised configuration. When large-scale trash removal device 74 is to be lowered from the raised state, arm 67*b* is drawn up and the engagement between the hooked section of hooked hole 68 and shaft 78*b* is disabled. This will cause large-scale trash removal device 74 to return back to the ground from its own weight.

The description above covered the embodiment of large-scale trash removal device 74. However, in another embodiment, there is no slot 71*b* disposed on vertical rod 71*a*. Thus, the height of brush 66*a* cannot be adjusted. Otherwise the structures of this embodiment are identical to those of the embodiment described above.

Figure 17:
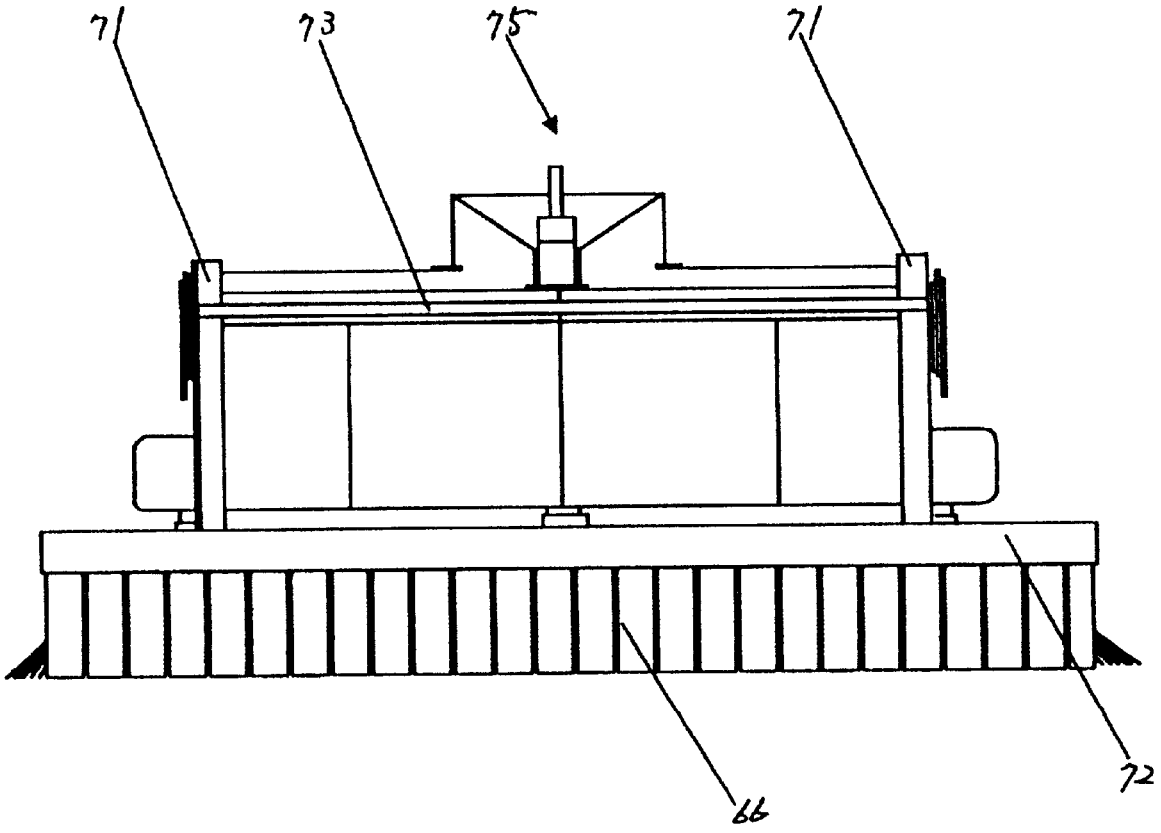
FIG. 17 is an elevational front-view of another embodiment of the large-scale trash removal device.
Figure 18:
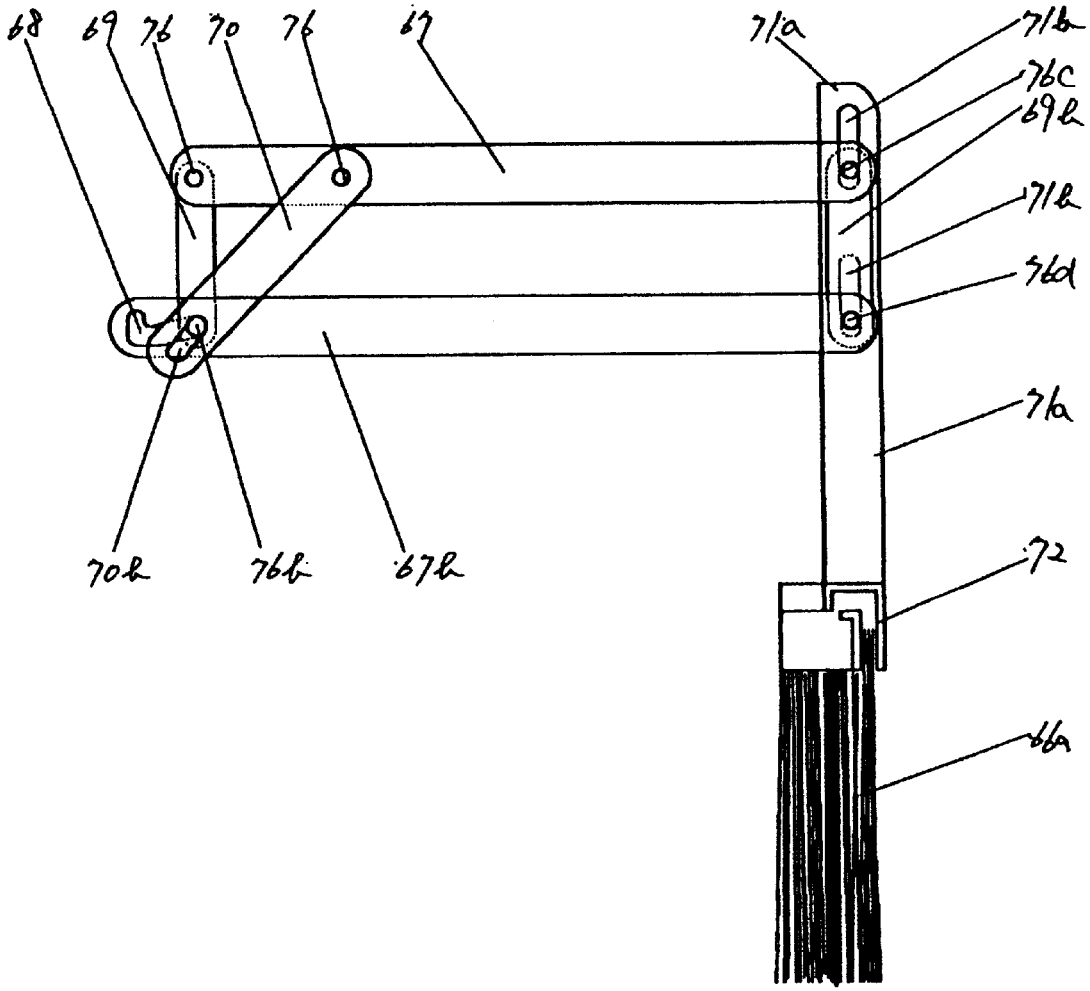
FIG. 18 is an elevational side-view drawing ofthe large-scale trash removal device of FIG. 13.
Figure 19:
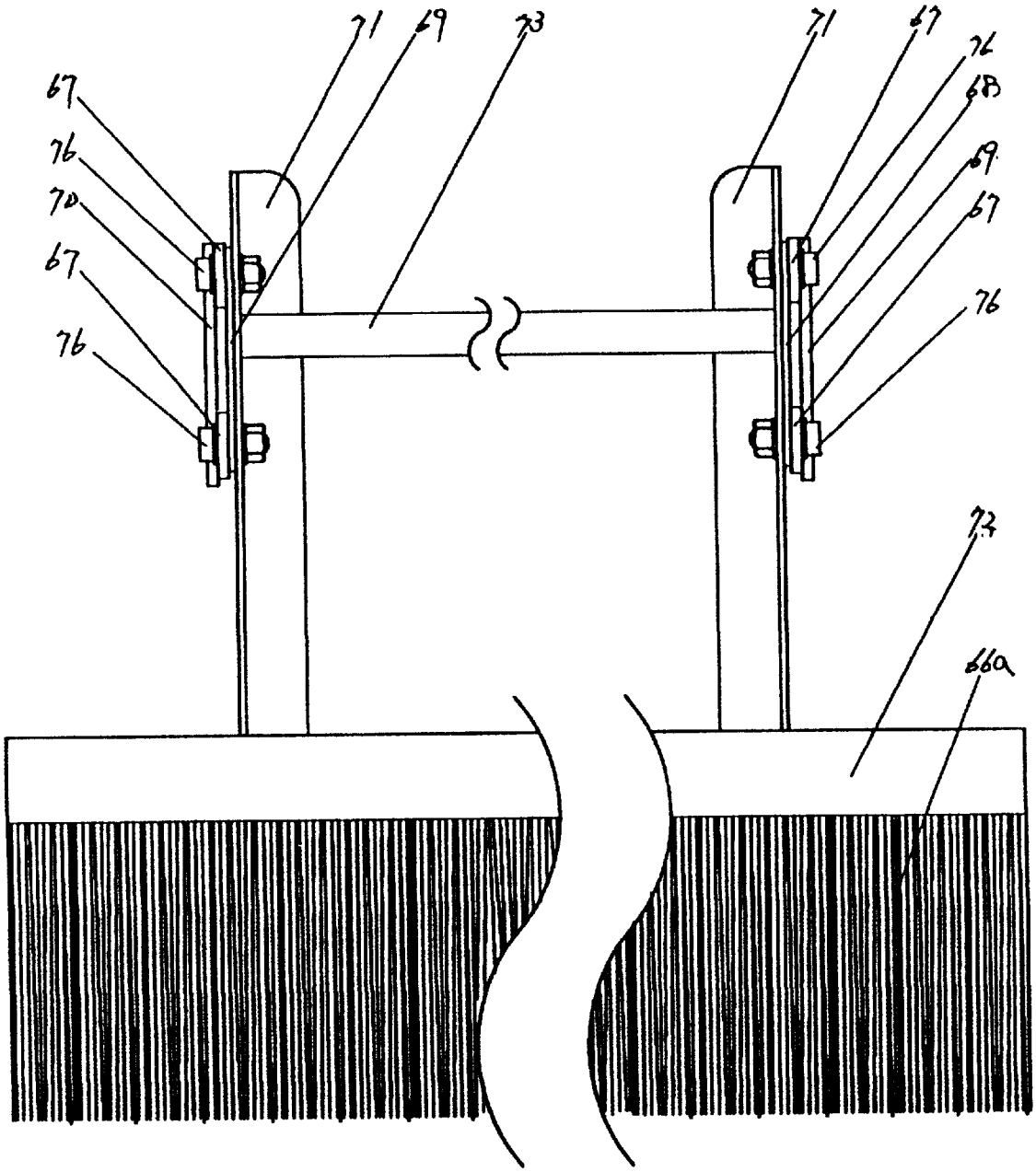
FIG. 19 is an enlarged elevational front-view of the large-scale trash removal device of FIG. 13.

Referring to FIG. 17, in the large-scale trash removal device 74, an elastic plate 66*b* made from a rubber plate is used instead of brush 66*a*. Otherwise the structures of this embodiment are identical to those of the above described embodiment.

Referring to the drawings, the following is a description of the large-scale trash removal device with a sprinkler device. Referring to FIG. 5, a frame 12 forms the upper portion of large-scale cleaning vehicle 75 and is supported at three points by a pair of rear wheels 18 and a single front-wheel caster 19. Rotating brushes 14 are attached to the end of two rotating brush support plates 13, which are attached pointing downward to the front of the frame. The vehicle is moved forward by inserting a fork into fork fitting member 35, which is movably attached to the upper surface of the frame.

Figure 21:
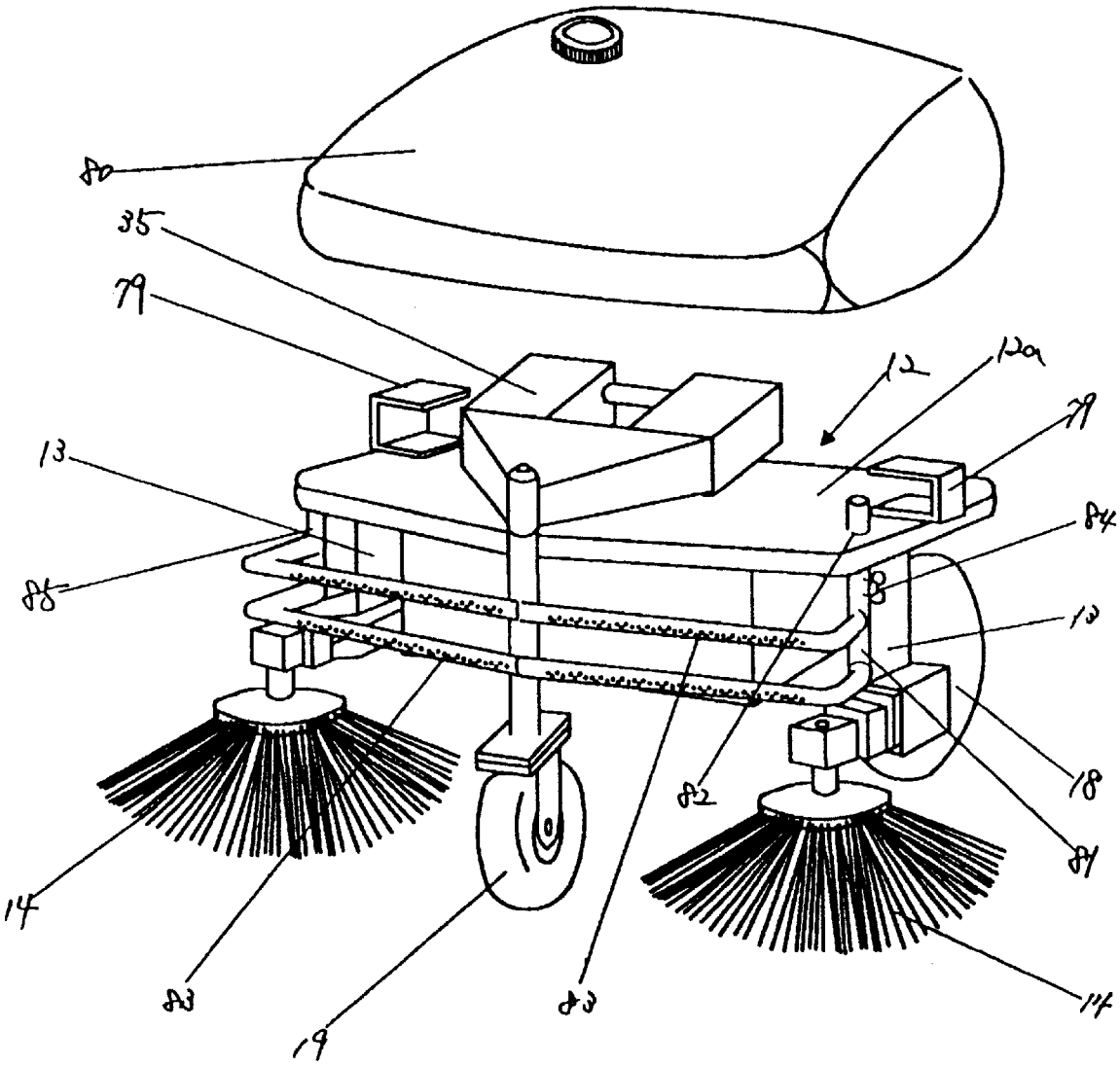
FIG. 21 is a perspective drawing of another embodiment of the large-scale cleaning vehicle with a water sprinkler device.
Figure 22:
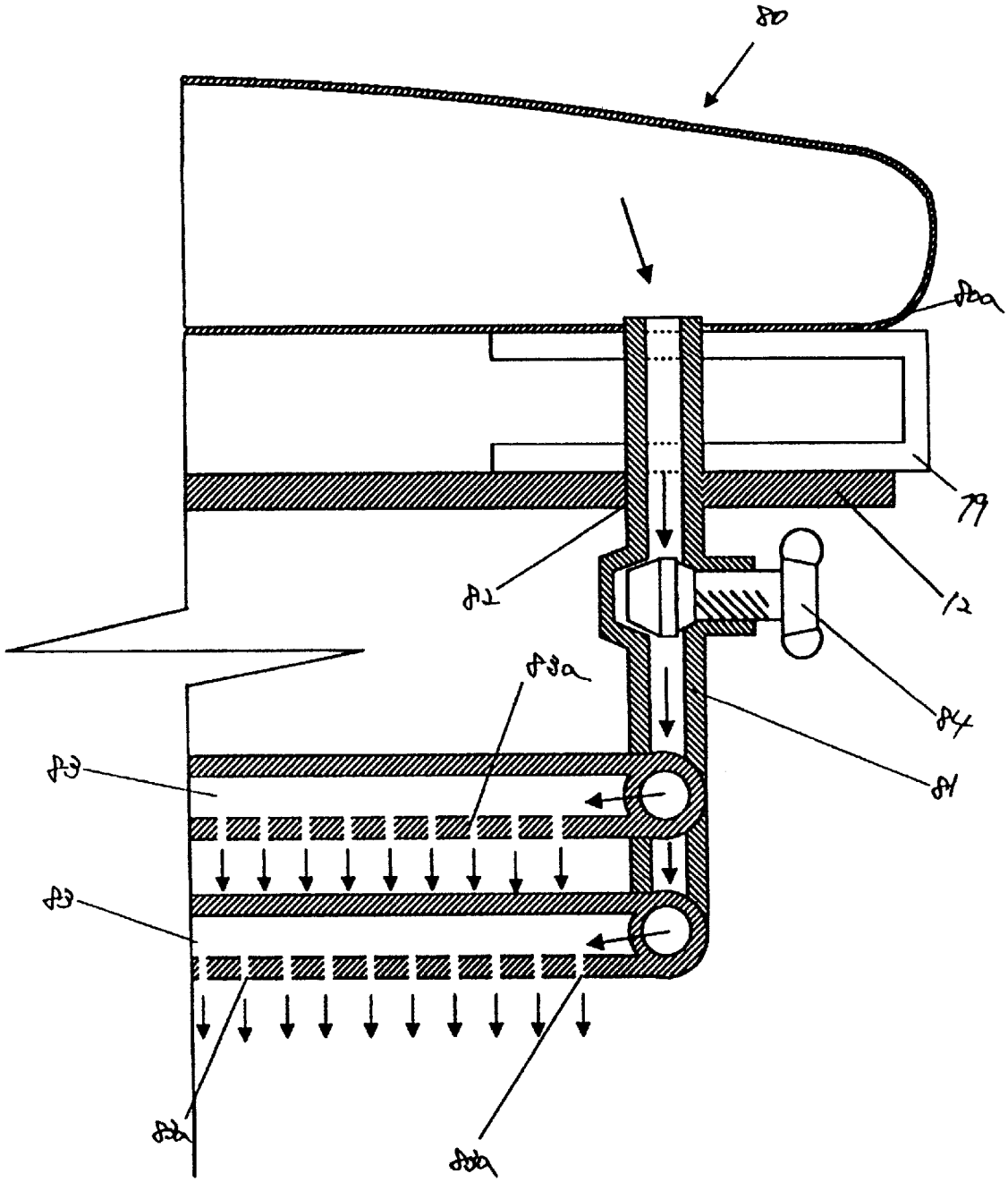
FIG. 22 is a schematic cross-section drawing of the large-scale cleaning vehicle with a water sprinkler device of FIG. 21.

Referring to FIGS. 21 and 22, a pair of bases 79 is attached to the left and right sides of upper surface 12*a* of frame 12, which forms the upper portion of large-scale cleaning vehicle 75. A water tank 80 is mounted and fixed on bases 79.

A hole 82 is formed toward the right end of upper surface 12*a* of the frame. A water pipe 81 is inserted in a water-tight manner into hole 82. A water pipe 81 projects up from hole 82. The upper end of water pipe 81 is inserted in a water-tight manner to the bottom of water tank 80. A prescribed number of sprinkler pipes 83 continuous with water pipe 81 is laid across the front of front-wheel caster 19, which supports frame 12. Multiple nozzles 83a are disposed on sprinkler pipe 83, and a cock valve 84 is attached to water pipe 81 to adjust the water flow. A left side of water pipes 83 is connected to a closed pipe 85, such that water entering water pipes 83 must exit through nozzles 83*a*.

The following is a description of the large-scale cleaning vehicle with a sound generating device. Referring to FIG. 5, a frame 12 is supported by a pair of rear wheels 18 and a single front-wheel caster 19. Rotating brush support plates 13 are attached facing down to the ends of frame 12 and support rotating brush 14.

Figure 23:
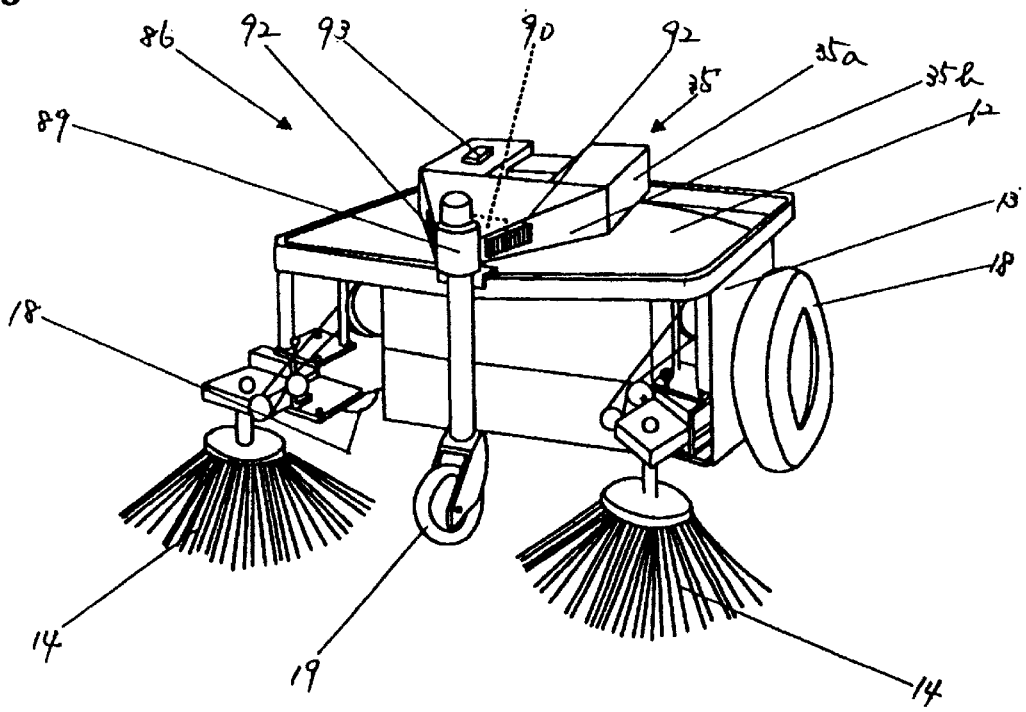
FIG. 23 is a perspective drawing of yet another embodiment of the large-scale cleaning vehicle with a sound generating device.
Figure 24:
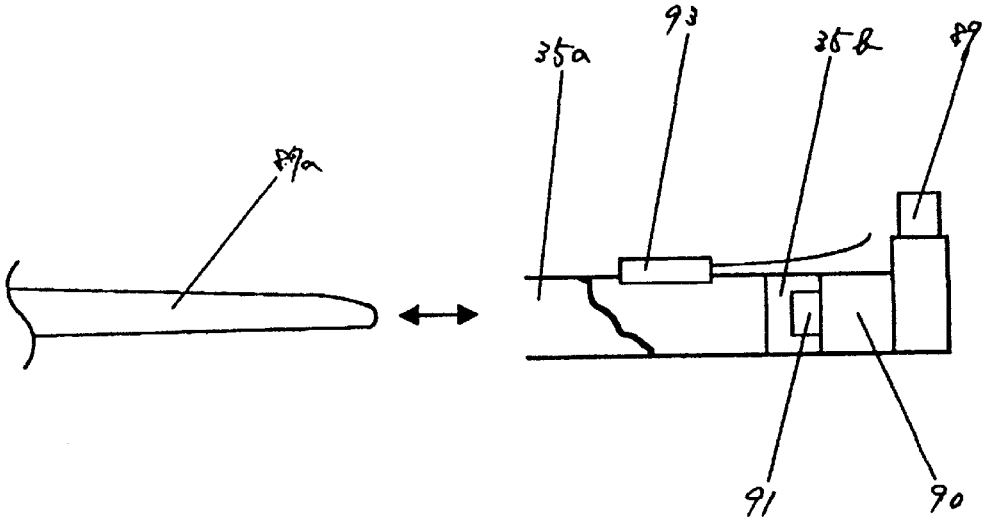
FIG. 24 is an expanded, partially cut-out cross-section drawing showing the sound generating device mounted in the fork fitting member of the large-scale cleaning vehicle of the present invention.

Referring now also to FIGS. 23 and 24, there is shown large-scale cleaning vehicle 75 with a sound generating device 91. A fork fitting member 35 is attached to frame 12. Fork fitting member 35 is able to move around a shaft 89, which supports front-wheel caster 19. Fork fitting member 35 comprises a forkfitting section 35*a* and a shaft 89, which are connected integrally via a connecting section 35*b*.

An inner wall is disposed inside connecting section 35*b* to form a sound generation chamber. Sound generating device 91, mounted in connecting section 35*b*, comprises a speaker 90 and an audio synthesizer IC or a melody IC. Speaker 90 is fixed so that it points toward a slit disposed on the side wall of connecting section 35*b*.

A sensor 93 is attached onto fork fitting section 35. When sensor 93 detects the insertion or removal of the fork, sound generating device 91 is activated and plays back melodies or warnings such as "Now cleaning," "Please be careful".

The following is a list of advantages of the invention.

1. In the large-scale cleaning vehicle according to the present invention, it is possible to rotate rotating brushes, sweeping brushes, and fans without the use of an engine. The large-scale cleaning vehicle is also capable of tight maneuvers. Furthermore, the forklift operator can let out the debris collected in the debris collection box while still in the driver's seat. Also, the large-scale cleaning vehicle can be operated on uneven ground without damage resulting to the claw on the debris collection box or to the ground.

2. Also, if the width of the area to be cleaned is the width in which the large-scale cleaning vehicle can operate, the rotating brushes can be rotated and debris collection can be performed. Furthermore, the angle of the rotating brush support member can be changed so that the width between the rotating brushes is fixed to a prescribed width when collecting debris.

3. The rotating brushes can be raised when the large-scale cleaning vehicle is moving while the rotating brushes are not being used, or when the large-scale cleaning vehicle is stationary. Thus, since the ends of the rotating brushes are not in contact with the ground, they will not be deformed and debris collection can be performed over a long period while avoiding wear.

4. A foot-lever formed in the shape of a bell crank and the elastic force of a spring can be used to perform one-touch operation of the foot lever simply by kicking it down or up.

5. Large-scale trash that could not be removed with conventional large-scale cleaning vehicles can be pushed and removed. Also, when large-scale trash is not dispersed, it can be lifted up, and small-scale trash can be efficiently removed. Furthermore, the ground-contact height of the brush or an elastic plate made from a rubber plate or the like can be freely adjusted according to the unevenness of the ground.

6. Because water is sprinkled, the dust from the ground does not rise up, and the debris collection is made more efficient. Also, the operator does not breathe in dust, allowing a healthier environment. The removal of debris adhered to the ground is also made more easy by the sprinkled water. Furthermore, since the rotating brush brushes against the ground when it is wet with water, the ground is cleaned in addition to the debris being collected.

7. Cleaning work, which can become monotonous, is made more enjoyable and the cleaning operator's morale is improved. Also, since the safety of pedestrians is maintained through warnings, the operator can safely concentrate on the cleaning operation.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A large-scale cleaning vehicle comprising:

a vehicle frame body;

a fork insertion member movably attached to said vehicle frame body supported by a pair of rear wheels and a single front wheel;

a sound generating device on said large-scale cleaning vehicle;

rotating brush support brackets attached pointing downward on the bottom of the ends of said frame; and a rotating brush attached to an end of each of said brackets.

2. A cleaning vehicle, comprising:

a frame having a front end and a rear end;

an audible warning device on said cleaning vehicle;

an insertion member pivotally connected at said front end of said frame, said insertion member being shaped to receive a connecting member from a second vehicle which supplies a motive force to said cleaning vehicle;

said frame being supported by a rear wheel and a front wheel;

a rotating brush assembly connected to said front end of said frame;

at least one rotating brush rotatably connected to at least one rotating brush support plate, said at least one rotating brush support plate being pivotally connected to said rotating brush assembly, said at least one rotating brush support plate being pivotable between an outer position and an inner position to adjust a width of sweeping;

a sweeping brush positioned toward a rear end of said frame;

a debris collection box hingably connected at a bottom of said tray;

a fan being operationally connected to said debris collection box such that rotation of said fan pulls debris swept by said sweeping brush into said debris collection box; and each of said at least one rotating brush, said sweeping brush, and said fan being rotatably connected to said rear wheel such that said each of said at least one rotating brush, said sweeping brush, and said fan rotates when said rear wheel is rotated.

3. The cleaning vehicle of claim 2, wherein said audible warning device includes:

a sensor, sensing presence of said connecting member, mounted in said insertion member, said sensor having an output; and a sound generating device responsive to said output of said sensor.

4. The large-scale cleaning vehicle of claim 1, wherein said sound generating device includes:

a sensor, sensing operation of said large-scale cleaning vehicle, mounted on said vehicle frame body;

an output of said sensor driving said sound generating device.

* * * * *